US008904580B1

(12) United States Patent
Christensen et al.

(10) Patent No.: US 8,904,580 B1
(45) Date of Patent: Dec. 9, 2014

(54) SWADDLING ENCLOSURE AND METHODS OF USE AND MANUFACTURE THEREOF

(71) Applicant: ABNC LLC, Sandy, UT (US)

(72) Inventors: Natalie A. Christensen, Sandy, UT (US); Aaron L. Christensen, Sandy, UT (US)

(73) Assignee: ABNC LLC, Sandy, UT (US)

( * ) Notice: Subject to any disclaimer, the term of this patent is extended or adjusted under 35 U.S.C. 154(b) by 0 days.

(21) Appl. No.: 14/216,783

(22) Filed: Mar. 17, 2014

Related U.S. Application Data

(63) Continuation of application No. 13/291,989, filed on Nov. 8, 2011, now Pat. No. 8,695,133.

(60) Provisional application No. 61/411,213, filed on Nov. 8, 2010.

(51) Int. Cl.
*A47G 9/00* (2006.01)
*A47G 9/08* (2006.01)
*A41B 13/06* (2006.01)

(52) U.S. Cl.
CPC ..... *A41B 13/06* (2013.01); *A47G 9/083* (2013.01)
USPC ..... 5/494; 5/413 R; 5/482; 5/655; 2/69.5

(58) Field of Classification Search
CPC ..... A47G 9/02; A47G 9/0207; A47G 9/0223; A47G 9/083; A41B 13/06; A41B 13/065
USPC ..... 5/655, 482, 485, 494, 413 R; 2/69, 69.5; 128/872, 873
See application file for complete search history.

(56) References Cited

U.S. PATENT DOCUMENTS

| | | | | |
|---|---|---|---|---|
| 2,651,781 | A | 9/1953 | Buchholz | |
| 5,129,406 | A * | 7/1992 | Magnusen et al. | 128/873 |
| 5,560,043 | A * | 10/1996 | Armstrong | 2/69.5 |
| 5,722,094 | A * | 3/1998 | Ruefer | 2/69.5 |
| 6,415,442 | B1 | 7/2002 | Smith | |
| 6,868,566 | B2 * | 3/2005 | Gatten | 5/494 |
| 7,076,819 | B2 | 7/2006 | Trani | |
| 7,587,769 | B1 | 9/2009 | Mcdermott | |
| 8,191,188 | B2 | 6/2012 | Kaplan et al. | |
| 2011/0179546 | A1 * | 7/2011 | Millette et al. | 2/75 |

OTHER PUBLICATIONS

Swaddle Designs, The item of the design shown in Attachment A was described in a printed publication at least as early as Dec. 31, 2003.

(Continued)

*Primary Examiner* — Nicholas Polito
(74) *Attorney, Agent, or Firm* — Austin Rapp & Hardman

(57) ABSTRACT

An outer enclosure may comprise a first enclosure region defining a first enclosed space and a second enclosure region defining a second enclosed space. The first enclosure region may comprise a first opening edge, and the second enclosure region may comprise a second opening edge. The first and second enclosure regions each have an inner surface. A first inner arm enclosure region may be secured to the inner surface of the first enclosure region and, together with the first enclosure region, defines a first arm passageway having a first arm entry opening. A second inner arm enclosure region may be secured to the inner surface of the second enclosure region and, together with the second enclosure region, defines a second arm passageway having a second arm entry opening.

20 Claims, 23 Drawing Sheets

(56) References Cited

OTHER PUBLICATIONS

Swaddleme, The item of the design shown in Attachment B was on sale at least as early as Nov. 7, 2009.

Miracle Blanket, The item of the design shown in Attachment C was on sale at least as early as Nov. 7, 2009.

Woombie, The item of the design shown in Attachment D was on sale at least as early as Nov. 7, 2009.

* cited by examiner

Step 8

Step 7

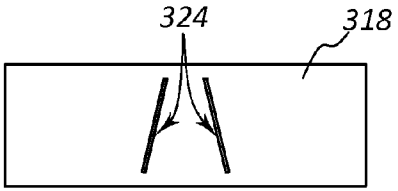
FIG. 6a
FIG. 6b
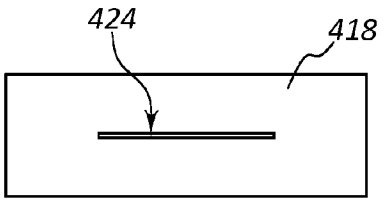
FIG. 6c
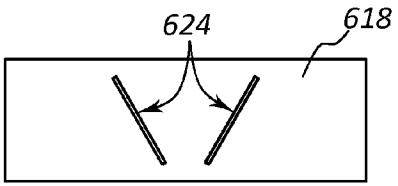
FIG. 6d
FIG. 6e
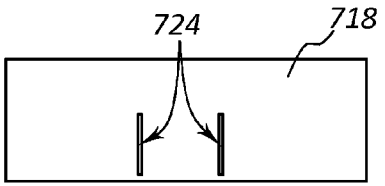
FIG. 6f
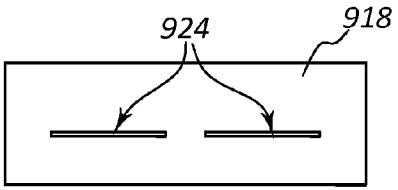
FIG. 6g
FIG. 6h

SWADDLING ENCLOSURE AND METHODS OF USE AND MANUFACTURE THEREOF

RELATED APPLICATIONS

This application claims priority to and is a continuation application of U.S. application Ser. No. 13/291,989, entitled SWADDLING ENCLOSURE AND METHODS OF USE AND MANUFACTURE THEREOF and filed on Nov. 8, 2011, which application claims priority to and is a non-provisional application of U.S. App. No. 61/411,213, entitled SWADDLING ENCLOSURE and filed on Nov. 8, 2010 and entitled SWADDLING ENCLOSURE. Each and every one of the foregoing applications is incorporated herein by this reference.

TECHNICAL FIELD

The present invention relates generally to a swaddling enclosure.

BACKGROUND

When sleeping, many infants experience a startle reflex, resulting in the rapid movement of the baby's arms. This rapid movement may cause the baby to awake, interrupting its sleep. Swaddling limits the movement of a baby's arms, diminishing the likelihood that a startle reflex will cause the baby to awake.

Enclosures for securely swaddling an infant suffer from a number of safety and/or convenience disadvantages. Accordingly, an enhanced swaddling disclosure is described below.

SUMMARY

The following presents a simplified summary of one or more embodiments in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

A swaddling enclosure is disclosed. In one embodiment, the swaddling enclosure may include an outer enclosure. The outer enclosure may comprise a first enclosure region defining a first enclosed space, and a second enclosure region defining a second enclosed space. The first enclosure region may comprise a first opening edge and a first neck edge, and the second enclosure region may comprise a second opening edge and a second neck edge. An opening may be bounded by the first opening edge and the second opening edge. The first and second opening edges may meet at a common point and be selectively securable to each other, such as by using a zipper, snaps or Velcro. A neck opening may be defined by the first neck edge and the second neck edge. The first neck edge may be contiguous with the first opening edge and the second neck edge, while the second neck edge may be contiguous with the first neck edge and the second opening edge. The first enclosure region may comprise a first shoulder region defining a first shoulder recess, and the second enclosure region may comprise a second shoulder region defining a second shoulder recess. The first enclosure region may have an inner surface adjacent to the first enclosed space, and the second enclosure region may have an inner surface adjacent to the second enclosed space.

The swaddling enclosure may further comprise an inner arm enclosure insert. The inner arm enclosure insert may include a first inner arm enclosure region secured to the inner surface of the first enclosure region. Together with the first enclosure region, the first inner arm enclosure region may define a first arm passageway having a first arm entry opening. The first arm entry opening may be disposed proximate the first shoulder region with the first arm passageway extending from the first shoulder region towards the first opening edge.

The inner arm enclosure insert may further include a second inner arm enclosure region secured to the inner surface of the second enclosure region. Together with the second enclosure region, the second inner arm enclosure region may define a second arm passageway having a second arm entry opening. The second arm entry opening may be disposed proximate the second shoulder region with the second arm passageway extending from the second shoulder region towards the second opening edge.

In one embodiment, the first arm passageway may have no opening besides the first opening, and the second arm passageway may have no opening besides the second opening. Also, the first arm entry opening may be disposed within the first enclosed space and the second arm entry opening may be disposed within the second enclosed space.

In one configuration, the first inner arm enclosure region and outer enclosure may define a first arm exit opening, and the second inner arm enclosure region and outer enclosure may define a second arm exit opening with first arm exit opening being disposed within the first enclosed space, and the second arm exit opening being disposed within the second enclosed space. The first arm entry opening and the first arm exit opening may be disposed at generally opposite ends of the first arm passageway. In addition, the first arm passageway may span from the first shoulder region to the first opening edge, and the second arm passageway may span from the second shoulder region to the second opening edge. The first and second opening edges may be selectively securable to each other, for example, using a zipper, snaps or Velcro.

The first and second inner arm enclosure regions may comprise a unitary piece of fabric or may be made from multiple pieces of fabric. Also, the first and second enclosure regions may comprise a unitary piece of fabric or may be made from multiple pieces of fabric.

The first enclosure region may comprise a first foot region defining a first foot recess. The first foot region may be disposed generally opposite the first shoulder region on the first enclosure region. Also, the second enclosure region may comprise a second foot region defining a second foot recess. The second foot region may be disposed generally opposite the second shoulder region on the second enclosure region.

The swaddling enclosure may further comprise a length-reducing mechanism for reducing a length of a consolidated enclosed space defined by the swaddling enclosure. The length-reducing mechanism may comprise snaps. For example, the snaps may comprise a first row of snaps spaced apart from a second row of snaps, wherein each snap in the first row corresponds to and is interlockable with a snap in the second row. Also, the length-reducing mechanism may comprise a drawstring.

A method of utilizing the swaddling enclosure is also disclosed. The method may comprise inserting a first arm of a baby through a first arm entry opening such that the first arm of the baby is positioned within a first arm passageway. The method may also comprise inserting a second arm of the baby through a second arm entry opening such that the second arm of the baby is positioned within a second arm passageway.

The method may also involve securing, at least partially, the first and second opening edges of the swaddling enclosure to each other such that the body of the baby is positioned within a first and second enclosed spaces.

This method may also include positioning feet of the baby within a foot region of the swaddling enclosure.

A method of manufacturing a swaddling enclosure is also disclosed. This method may comprise securing the first inner arm enclosure region to the inner surface of the first enclosure region and securing the second inner arm enclosure region to the inner surface of the second enclosure region. Also, securing the first inner arm enclosure region to the inner surface of the outer enclosure may involve sewing the first inner arm enclosure region to the first enclosure region along a perimeter sew line of the first inner arm enclosure with the perimeter sew line of the first inner arm enclosure traversing at least a portion of a perimeter of the first inner arm enclosure region.

The method of manufacturing may further comprise folding first and second front regions of the outer enclosure along outer enclosure fold lines such that the first and second front regions are generally disposed adjacent to a back region of the outer enclosure. This method may also involve sewing a foot region sew line on the first front region and a foot region sew line on the second front region to a foot region sew line on the back region of the outer enclosure.

The method of manufacturing the swaddling enclosure may further comprise sewing a first shoulder region sew line on the first front region of the outer enclosure to a second shoulder region sew line on the back region of the outer enclosure.

To the accomplishment of the foregoing and related ends, the one or more embodiments comprise the features hereinafter more fully described and particularly pointed out in the claims. The following description and the annexed drawings set forth in more detail certain illustrative aspects of the one or more embodiments. These aspects are indicative, however, of but a few of the various ways in which the principles of various embodiments can be employed.

BRIEF DESCRIPTION OF THE DRAWINGS

Exemplary embodiments of the invention will become more fully apparent from the following description and appended claims, taken in conjunction with the accompanying drawings. Understanding that these drawings depict only exemplary embodiments and are, therefore, not to be considered limiting of the invention's scope, the exemplary embodiments of the invention will be described with additional specificity and detail through use of the accompanying drawings in which:

FIGS. 6*a-h*, 7*a-c*, 8*a-b* and 9*a-b* illustrate alternative embodiments of an inner arm enclosure insert;

DETAILED DESCRIPTION

The presently preferred embodiments of the present invention will be best understood by reference to the drawings, wherein like parts may be designated by like numerals. It will be readily understood that the components of the present invention, as generally described and illustrated in the figures herein, could be arranged and designed in a wide variety of different configurations. Thus, the following more detailed description of the embodiments of the present invention, as represented in the Figures, is not intended to limit the scope of the invention, as claimed, but is merely representative of presently preferred embodiments of the invention.

The word "exemplary" is used exclusively herein to can mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

Figure 1:
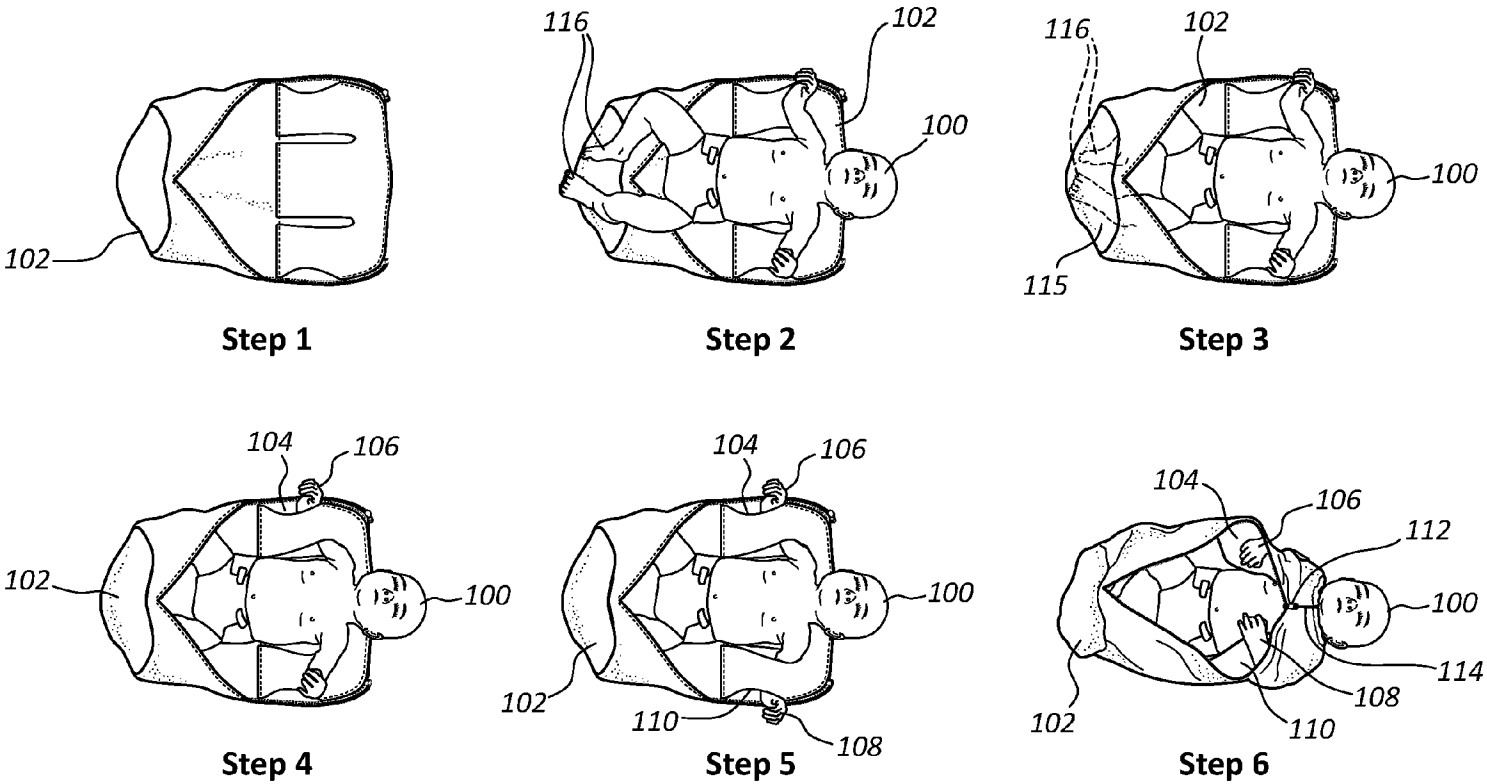
FIGS. 1-2 illustrate a method of utilizing an enhanced swaddling enclosure.
Figure 2:
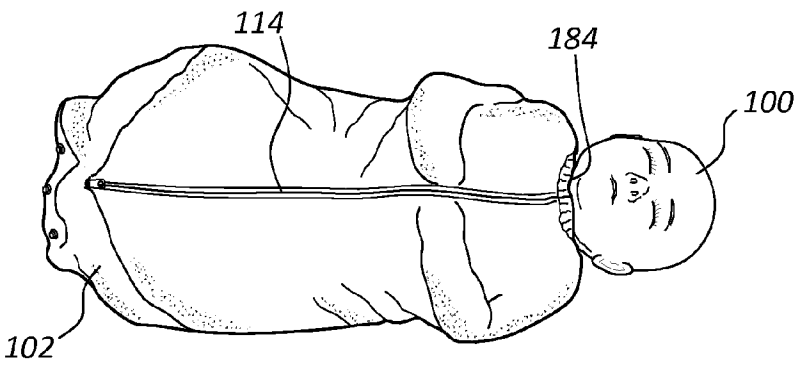
Figure 2:
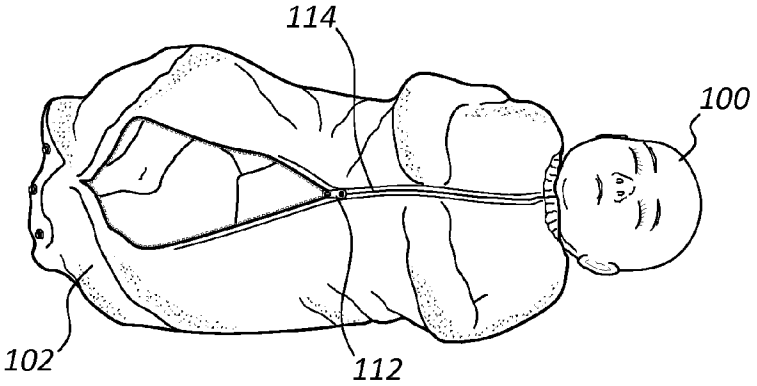

FIGS. 1-2 comprise drawings illustrating a method of using one embodiment of a swaddling enclosure 102 of the present invention. Eight steps are illustrated. The eight steps shown in FIGS. 1-2 are merely illustrative. Additional steps may be included or the steps may be performed in a different order than illustrated. Also, certain steps may be omitted.

In step 1, the swaddling enclosure 102 may be laid flat and in an open condition. In step 2, the baby 100 may then be placed on the open swaddling enclosure 102. The feet 116 of the baby 100 may then be tucked inside a foot area 115 of the swaddling enclosure 102 in step 3. A first arm 106 of the baby 100 may be inserted into a first arm passageway 104 in step 4. Then, a second arm 108 of the baby may be inserted into a second arm passageway 110 in step 5. The close-down grasp mechanism 112 may then be moved to engage a zipper 114 in step 6. Closing of the illustrated zipper 114 may then be initiated and partially completed, as shown in step 7. Finally, in step 8, the zipper 114 is fully closed with the baby 100 disposed therein.

The first and second arm passageways 104, 110 shown in FIGS. 1 and 2 enable the baby to feel comfortable and move its arms 106, 108 while limiting the movement of the baby's arms 106, 108. Without these passageways 104, 110, a baby 100 could move its arm 106, 108 into the neck opening 184, potentially constricting or blocking the breathing passageway of the baby 100.

Figure 3:
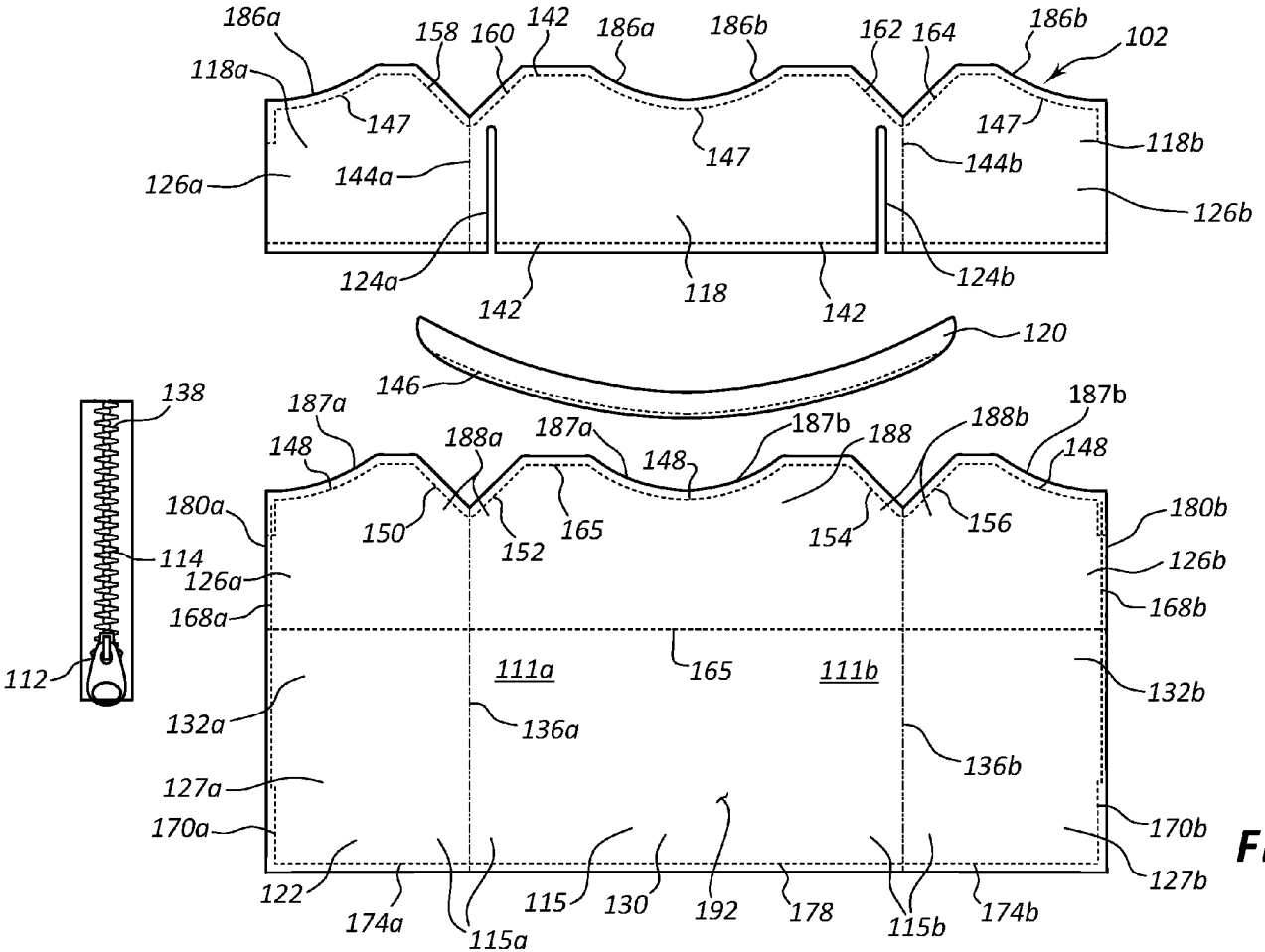
FIG. 3 comprises an assembly view of one embodiment of the swaddling enclosure.

FIG. 3 illustrates an assembly view of one embodiment of a swaddling enclosure 102 of the present invention. The illustrated embodiment may include an inner arm enclosure insert 118, a collar piece 120, an outer enclosure 122, a zipper 114. The embodiment provided in FIG. 3 is merely illustrative. In certain embodiments, for example, the collar piece 120 may be omitted and the zipper 114 may be replaced with another securing mechanism, such as snaps or Velcro.

In the illustrated embodiment, the inner arm enclosure insert 118, collar piece 120, and outer enclosure 122 may be made of a material, such as fabric (e.g., a cotton, polyester, or Lycra fabric or a cotton/Lycra blend, a cotton/polyester/Lycra blend, or bamboo/Lycra blend).

In FIG. 3, the dot-dashed lines represent areas in which the material (such as fabric) may be folded during assembly. The dashed lines indicate where the material may be secured to another piece of material or to the zipper 114 using, for example, stitching.

The inner arm enclosure insert 118 includes a first and a second inner arm enclosure region 118*a-b*. Each inner arm enclosure region 118*a-b* may include arm entry openings 124*a-b* into which an arm 106, 108 of the baby 100 (Shown in FIG. 1) may be inserted when the swaddling enclosure 102 is assembled. The arm entry openings 124*a-b* may be slits (as shown in FIG. 3), rounded openings, or may be formed in other shapes. A first arm exit opening 126*a* and a second arm exit opening 126*b* may also be included. These openings 126*a-b* may comprise areas in which the inner arm enclosure insert 118 is not secured to the outer enclosure 122, thus enabling a baby's hand and/or arm 106, 108 to pass through the first or second arm exit opening 126*a-b*. The first and second arm exit openings 126*a-b* are optional and can be varied in size, orientation, and shape. For example, the first and second arm exit openings 126*a-b* may comprise openings in the inner arm enclosure insert 118 rather than being unsewn regions.

The inner arm enclosure insert 118 may also comprise a first neck edge 186*a* and a second neck edge 186*b*, as will be further illustrated in connection with FIG. 4. The first neck edge 186*a* and the second neck edge 186*b* jointly may comprise a neck edge 186*a-b*.

The collar piece 120 may be embodied in various ways. For example, as illustrated in FIG. 3, the collar piece 120 may comprise a piece of material in an arcuate shape. Alternatively, for example, the collar piece 120 may be wider and form a fold-over type collar.

The outer enclosure 122 includes a back region 130, a first front region 132*a*, and a second front region 132*b*. The outer enclosure 122 may be further defined to include a first enclosure region 127*a* and a second enclosure region 127*b*. In one embodiment, the first enclosure region 127*a* includes the first front region 132*a* and the half 111*a* of the back region 130 adjacent to the first front region 132*a*, while the second enclosure region 127*b* includes the second front region 132*b* and the half 111*b* of the back region 130 adjacent to the second front region 132*b*. The outer enclosure 122 also includes first and second outer enclosure fold lines 136*a-b* on which the outer enclosure 122 may be generally folded during assembly. The outer enclosure 122 also includes an inner surface 192 disposed within an interior of the outer enclosure 122 when assembled to form a swaddling enclosure 102.

The first enclosure region 127*a* may include a first foot region 115*a*, a first shoulder region 188*a*, a first neck edge 187*a*, and a first opening edge 180*a*. The second enclosure region 127*b* may include a second foot region 115*b*, a second shoulder region 188*b*, a second neck edge 187*b*, and a second opening edge 180*b*. The first foot region 115*a* and the second foot region 115*b* may jointly comprise a foot area 115.

The zipper 114 includes zipper teeth 138 and a down-zip grasp mechanism 112, which enables opening and closing of the zipper 114.

In one embodiment, the swaddling enclosure 102 may be assembled in the following manner. This method of assembly is merely illustrative. Various steps may be performed in a different order than the order provided below. Also, various steps may be omitted, added, or may be performed simultaneously with other steps. The inner arm enclosure insert 118 may be secured to the shoulder region 188 of the outer enclosure 122 along the perimeter sew line 142 (which spans around a perimeter of the inner arm enclosure insert 118 with the exception, for example, of the first and second arm exit openings 126*a-b* and the first and second arm entry openings 124*a-b*) of the inner arm enclosure insert 118 along the matching sew line 165 of the outer enclosure 122. Accordingly, first and second shoulder sew lines 150, 152 of the outer enclosure 122 may be secured, respectively, to the first and second shoulder sew lines 158, 160 of the inner arm enclosure insert 118. Also, the third and fourth shoulder sew lines 154, 156 of the outer enclosure 122 may be secured, respectively, to the third and fourth shoulder sew lines 162, 164 of the inner arm enclosure insert 118. Also, the collar sew line 148 of the outer enclosure 122 may be secured to the collar sew line 147 of the inner arm enclosure insert 118.

The first and second front regions 132*a-b* of the outer enclosure 122 may be folded along the first and second outer enclosure fold lines 136*a-b* and such that the first and second front regions 132*a-b* are generally disposed adjacent to the back region 130 of the outer enclosure 122. A first shoulder sew line 150 of the outer enclosure 122 may then be secured to a second shoulder sew line 152 of outer enclosure 122, a third shoulder sew line 154 of the outer enclosure 122 may be secured to a fourth shoulder sew line 156 of the outer enclosure 122. During this procedure, a first shoulder sew line 158 of the inner arm enclosure insert 118 may then be secured to a second shoulder sew line 160 of inner arm enclosure insert 118, and a third shoulder sew line 162 of the inner arm enclosure insert 118 may be secured to a fourth shoulder sew line 164 of the inner arm enclosure insert 118. As the inner arm enclosure insert 118 may have previously been secured to the outer enclosure 122, the inner arm enclosure 118 may also be folded across the insert fold lines 144*a-b* of the inner arm enclosure insert 118, as well. Also, the first and second foot region sew lines 170*a-b* of the first and second front regions 132*a-b*, respectively, may be secured to one another. In addition, the third and fourth foot region sew lines 174*a-b* of the first and second front regions 132*a-b*, respectively, may be secured to the foot region sew line 178 of the back region 130 of the outer enclosure 122. The zipper 114 may also be secured to the zipper sew lines 168*a-b* of the outer enclosure 122.

The collar piece 120 may then be secured along the collar sew line 146 to the outer enclosure collar sew line 148 of the outer enclosure 122 and/or the inner arm insert collar sew line 147 of the inner arm insert enclosure 118, as shown in FIG. 3.

Again, the embodiment illustrated in FIG. 3 is merely illustrative. Other embodiments are, of course possible within the scope of the disclosed subject matter. For example, in one embodiment, the first shoulder sew line 150 of the outer enclosure 122 may be secured to a second shoulder sew line 152 of outer enclosure 122, and the third shoulder sew line 154 of the outer enclosure 122 may be secured to a fourth shoulder sew line 156 of the outer enclosure 122. Also, the first shoulder sew line 158 of the inner arm enclosure insert 118 may then be secured to the second shoulder sew line 160 of inner arm enclosure insert 118, and the third shoulder sew line 162 of the inner arm enclosure insert 118 may be secured to the fourth shoulder sew line 164 of the inner arm enclosure insert 118. Thereafter, inner arm enclosure insert 118 may be secured to the shoulder region 188 of the outer enclosure 122.

Figure 4:
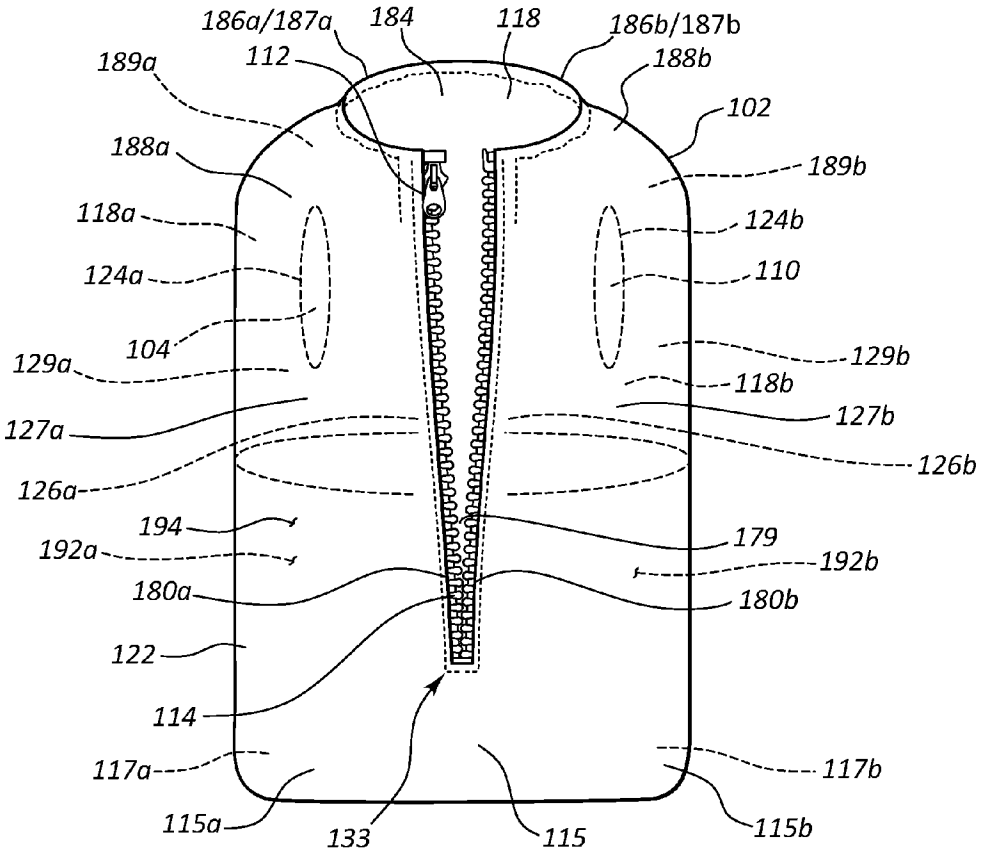
FIG. 4 is a perspective view of one embodiment of the swaddling enclosure.

FIG. 4 illustrates a perspective view of the swaddling enclosure 102 with the inner arm enclosure insert 118 shown in hidden lines within the outer enclosure 122. Also, the zipper 114 is shown in an unzipped state. The arm entry openings 124*a-b* within the inner arm enclosure 118*a-b* are also illustrated in hidden lines. Thus, FIG. 4 serves to illustrate the first and second arm passageways 104, 110.

The outer enclosure 122 may comprise a first enclosure region 127*a* that defines a first enclosed space 129*a*, and a second enclosure region 127*b* that defines a second enclosed space 129*b*. The first enclosure region 127*a* may also comprise a first opening edge 180*a* and a first neck edge 187*a*, and the second enclosure region 127*b* may comprise a second opening edge 180*b* and a second neck edge 187*b*.

An opening 179 may be bounded by the first opening edge 180*a* and the second opening edge 180*b*. The first and second opening edges 180*a-b* may meet at a common point 133 and may be selectively securable to each other, using, for example, a zipper, Velcro, or snaps.

A neck opening 184 may be defined by the first neck edge 186*a*/187*a* and the second neck edge 186*b*/187*b*. The first neck edge 186*a*/187*a* may be contiguous with the first opening edge 180*a* and the second neck edge 186*b*/187*b*, and the second neck edge 186*b*/187*b* may be contiguous with the first neck edge 186*a*/187*a* and the second opening edge 180*b*.

The first enclosure region 127*a* may comprise a first shoulder region 188*a* that defines a first shoulder recess 189*a*, and the second enclosure region 127*b* may comprise a second shoulder region 188*b* that defines a second shoulder recess 189*b*. The first enclosure region 127*a* may have an inner surface 192*a* adjacent to the first enclosed space 129*a*, and the second enclosure region 127*b* may have an inner surface 192*b* adjacent to the second enclosed space 129*b*. The first and second enclosure regions 127*a-b* may jointly define a consolidated enclosed space 129*a-b*.

The inner arm enclosure insert 118 may comprise a first inner arm enclosure region 118*a* and a second inner arm enclosure region 118*b*. The first inner arm enclosure region 118*a* may be secured to the inner surface 192*a* of the first enclosure region 127*a* and, together with the first enclosure region 127*a*, may define a first arm passageway 104 having a first arm entry opening 124*a*. The first arm entry opening 124*a* may be disposed proximate the first shoulder region 188*a*, and the first arm passageway 104 may extend from the first shoulder region 188*a* towards the first opening edge 180*a*.

The second inner arm enclosure region 118*b* may be secured to the inner surface 192*b* of the second enclosure region 127*b* and, together with the second enclosure region 127*b*, may define a second arm passageway 110 having a second arm entry opening 124*b*. The second arm entry opening 124*b* may be disposed proximate the second shoulder region 188*b* and the second arm passageway 110 may extend from the second shoulder region 188*b* towards the second opening edge 180*b*.

In one embodiment, the first arm passageway 104 may span from the first shoulder region 188*a* to the first opening edge 180*a*, and/or the second arm passageway 110 may span from the second shoulder region 188*b* to the second opening edge 180*b*.

The first arm passageway 104 may optionally include a first arm exit opening 126*a*, and the second arm passageway 110 may optionally include a second arm exit opening 126*b*. As illustrated, the first and second exit arm openings 126*a-b* may be formed by unstitched regions or, alternatively, could be formed by openings (not shown) within the inner arm enclosure insert 118. In one embodiment, the first arm entry opening 124*a* and the first arm exit opening 126*a* may be disposed at generally opposite ends of the first arm passageway 104. Also, the second arm entry opening 124*b* and the second arm exit opening 126*b* may be disposed at generally opposite ends of the second arm passageway 110.

The first enclosure region 127*a* may further include a first foot region 115*a*, while the second enclosure region 127*b* may include a second foot region 115*b*. Together, the first foot region 115*a* and the second foot region 115*b* may form a foot area 115. The first foot region 115*a* may define a first foot recess 117*a*, while the second foot region 115*b* may define a second foot recess 117*b*. The first foot region 115*a* may be disposed generally opposite the first shoulder region 188*a* on the first enclosure region 127*a*. Also, the second foot region 115*b* may be disposed generally opposite the second shoulder region 188*b* on the second enclosure region 127*b*.

As indicated above, the outer enclosure 122 includes an inner surface 192*a* of the first enclosure region 127*a*, and an inner surface 192*b* of the second enclosure region 127*b*. Jointly, these inner surfaces 192*a-b* may form an inner surface 192 of the outer enclosure 122. The outer enclosure 122 may further include an outer surface 194.

The illustrated zipper 114 comprises a close-down grasp mechanism 112. The close-down grasp mechanism 112 closes the zipper 114 as it is pushed toward the foot area 115 of the swaddling enclosure 102. Conversely, the close-down grasp mechanism 112 opens the zipper 114 as it is pushed toward the neck opening 184.

The embodiment shown in FIG. 4 is merely illustrative. For example, the inner arm enclosure insert 118 may be made from one or more pieces of fabric. Also, the outer enclosure 122 may likewise be made from one or multiple pieces of fabric.

The components identified FIGS. 1-4, although not specifically identified with reference numbers, are present in many of the embodiments hereinafter disclosed. These components of FIGS. 1-4 may be included or comprise a portion of the following disclosed embodiments, as will be understood by those of skill in the art.

Figure 5B:
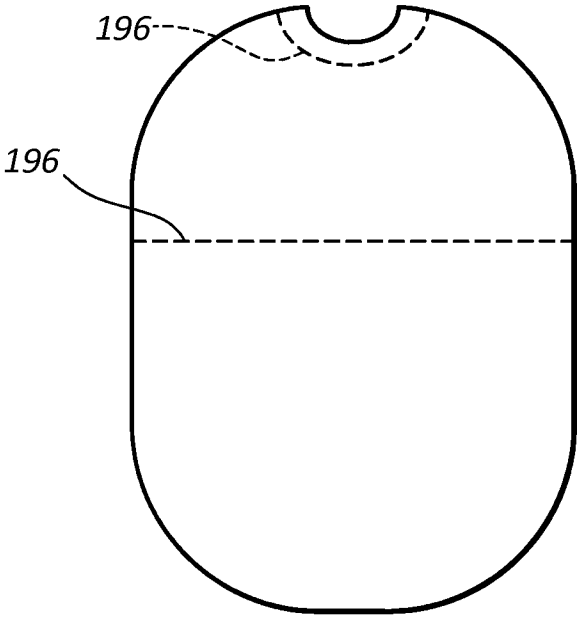
FIGS. 5*a-b*, respectively, illustrate front and back views of one embodiment of the swaddling enclosure.
Figure 5A:
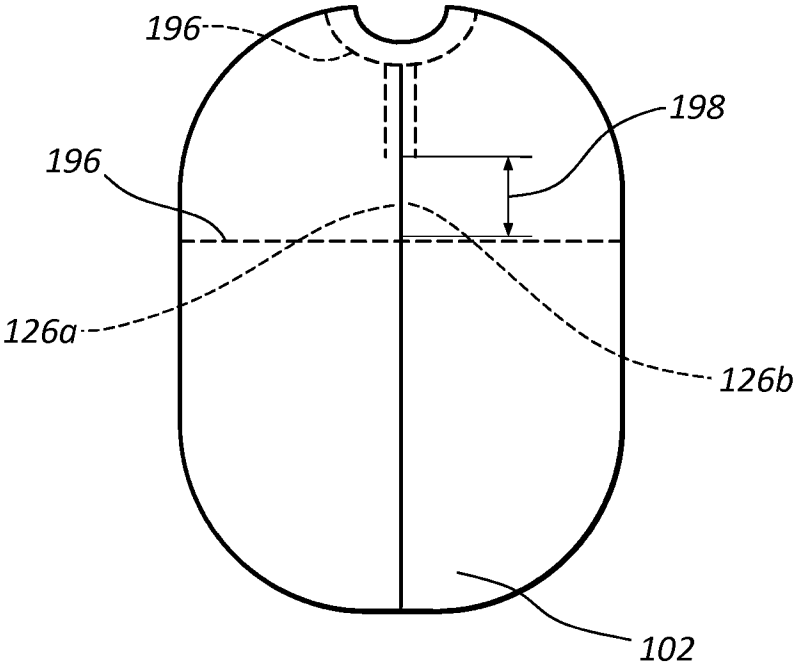

FIGS. 5*a-b* illustrate front and back views of one embodiment of the swaddling enclosure 102, respectively. As illustrated, the arm exit opening 126*a-b* of the swaddling enclosure 102 may be varied in length 198. In FIGS. 5*a-b*, the stitching lines of the inner arm enclosure insert 196 are illustrated in dashed lines.

FIGS. 6*a-h* illustrate various embodiments of the inner arm enclosure insert 218, 318, 418, 518, 618, 718, 818, 918. As illustrated in these figures, the arm entry openings 224, 324, 524, 624, 724, 824, 924 or arm entry opening 424 may be varied in size, shape, number, and position.

Figure 7C:
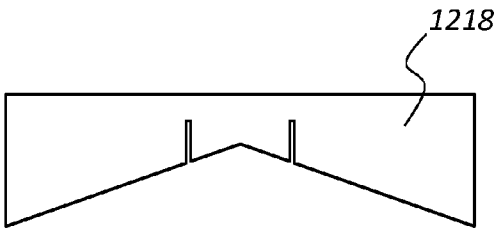
Figure 7B:
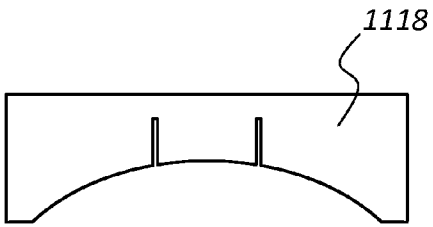
Figure 7A:
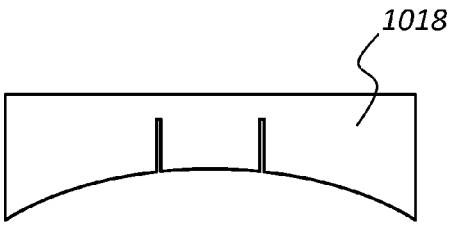

FIGS. 7*a-c* illustrate additional embodiments of the inner arm enclosure insert 1018, 1118, 1218. As shown in these figures, the shape of the inner arm enclosure insert 1018, 1118, 1218 may be varied within the scope of the disclosed subject matter.

Figure 8B:
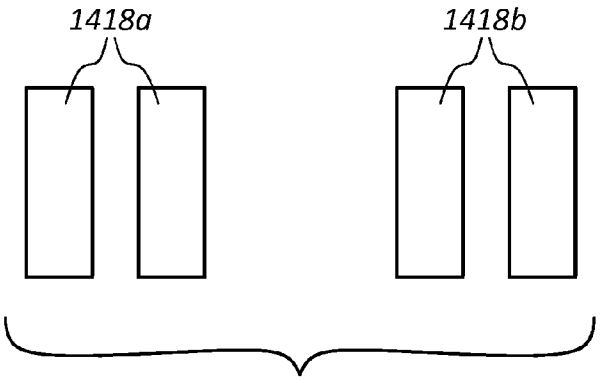
Figure 8A:
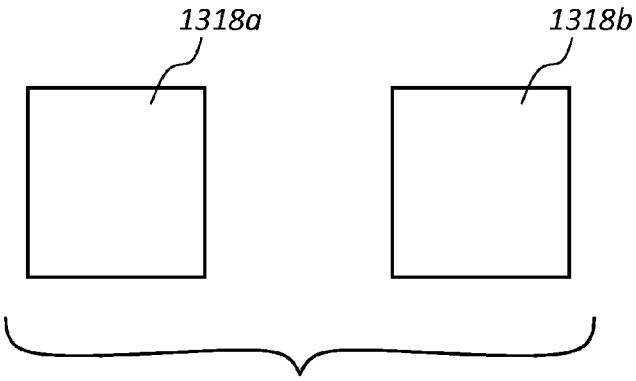

FIGS. 8*a-b* illustrate alternative embodiments of the inner arm enclosure insert 1318*a-b*, 1418*a-b* in which the inner arm enclosure insert 1318*a-b*, 1418*a-b* involves two or more separate pieces of material. As illustrated, each inner arm enclosure region 1418*a-b* may be comprised of one or more separate pieces of material. For example, each of the inner arm enclosure inserts 1418*a-b* could comprise a series of elastic straps. Of course, the number of straps or pieces of material may be varied within the scope of the disclosed subject matter.

Figure 9B:
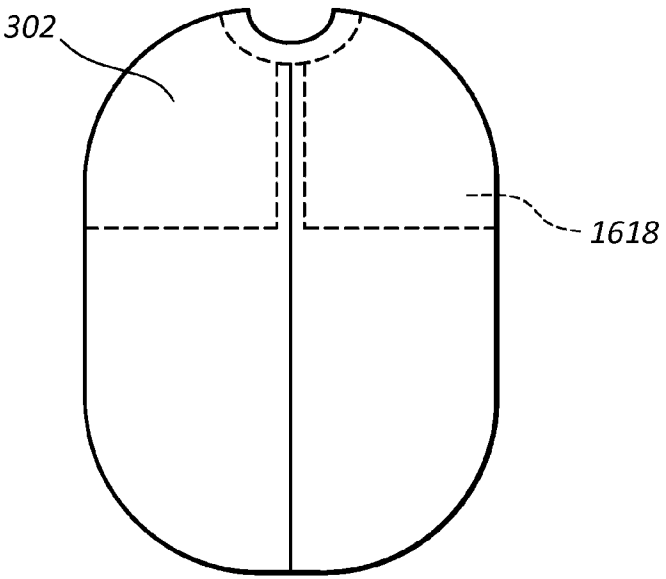
Figure 9A:
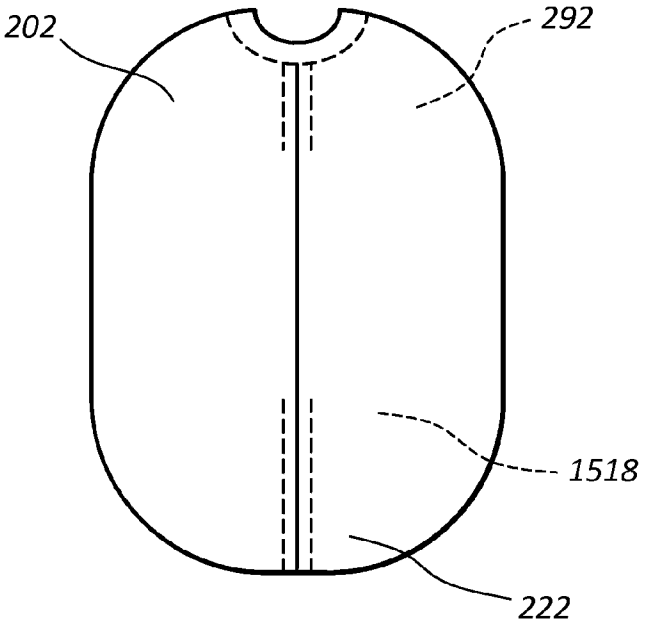

FIGS. 9*a-b* also illustrate embodiments of swaddling enclosure 202, 302 having alternative embodiments of the inner arm enclosure insert 1518, 1618. For example, FIG. 9*a* illustrates an inner arm enclosure insert 1518 that occupies the entire inner surface 292 of the outer enclosure 222. In addition, FIG. 9*b* illustrates an inner arm enclosure insert 1618 that is devoid of arm exit openings 126*a-b*(shown, for example, in FIG. 4).

Figure 10B:
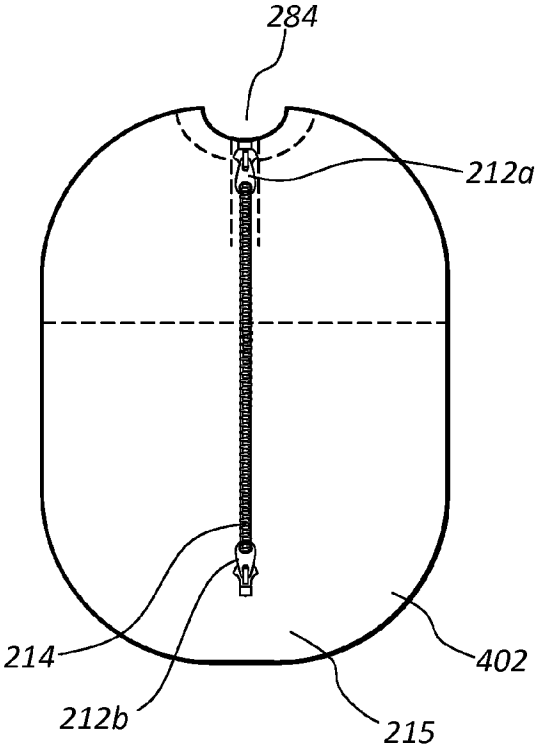
FIGS. 10*a-b* illustrate an alternative configurations of a zipper that may be utilized as part of the swaddling enclosure.
Figure 10A:
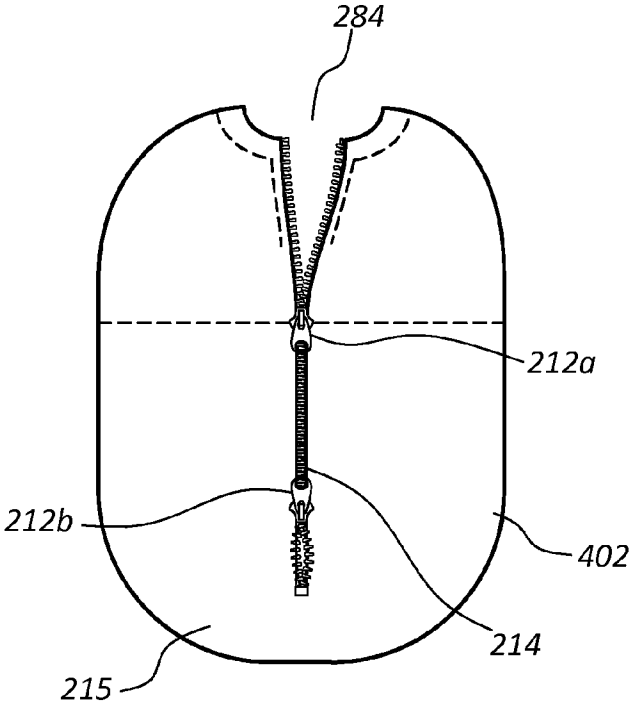

FIGS. 10*a-b* illustrate alternative embodiments of a zipper 214 used in connection with the swaddling enclosure 402. FIGS. 10*a-b* illustrates a zipper 214 with both a close-up grasp mechanism 212*a* and a close-down grasp mechanism 212*b*. The close-down grasp mechanism 212*b* closes the zipper 214 as it is pushed toward the foot area 215 of the swaddling enclosure 402. Conversely, the close-down grasp mechanism 212*b* opens the zipper 114 as it is pushed toward the neck opening 284. The close-up grasp mechanism 212*a* opens the zipper 214 as it is pushed toward the foot area 215 of the swaddling enclosure 402. Conversely, the close-up grasp mechanism 212*a* closes the zipper 214 as it is pushed toward the neck opening 284. FIG. 10*a* illustrates a zipper 214 in a partially open state, while FIG. 10*b* illustrates the zipper 214 in a fully closed state. In the disclosed embodiment, a single swaddling enclosure 402 may include a close-up grasp mechanism 212*a*, a close-down grasp mechanism 212*b*, or both 212*a-b*.

Figure 11B:
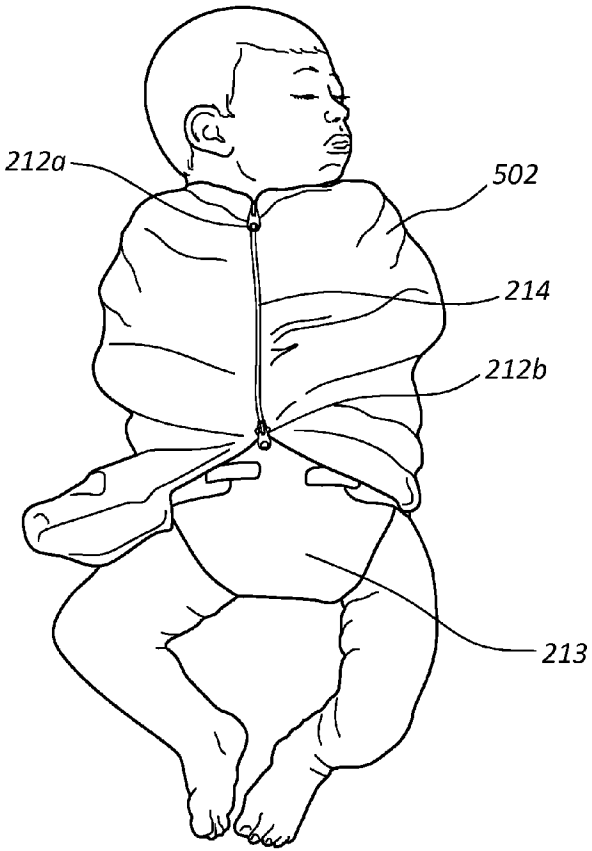
FIGS. 11*a-b* illustrate embodiments of swaddling enclosures with a two-way zipper partially open.
Figure 11A:
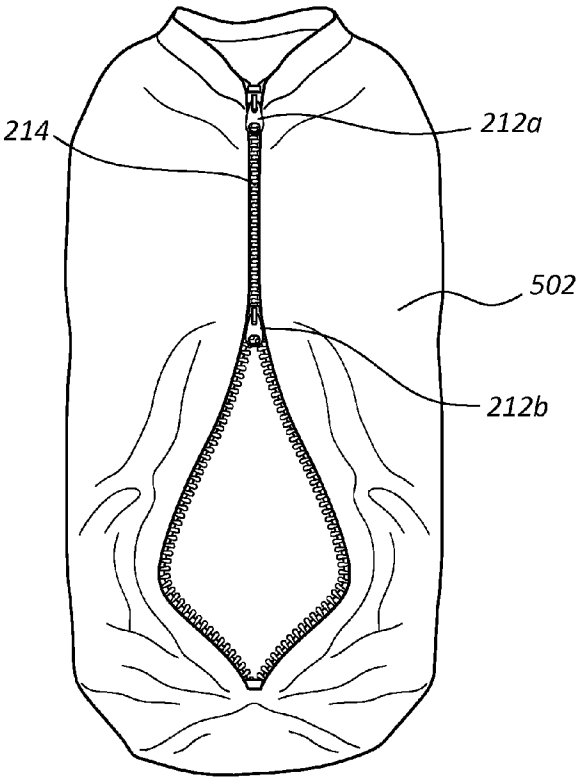

FIGS. 11*a-b* illustrates an embodiment of the swaddling enclosure 502 including a zipper 214 with both a close-up and a close-down grasp mechanism 212*a-b*. The illustrated embodiment enables the close-down grasp mechanism 212*b* to be partially dislodged from its closed position such that the baby's diaper 213 may be changed without removing the swaddling enclosure 502, as shown in FIG. 11*b*.

Figure 12C:
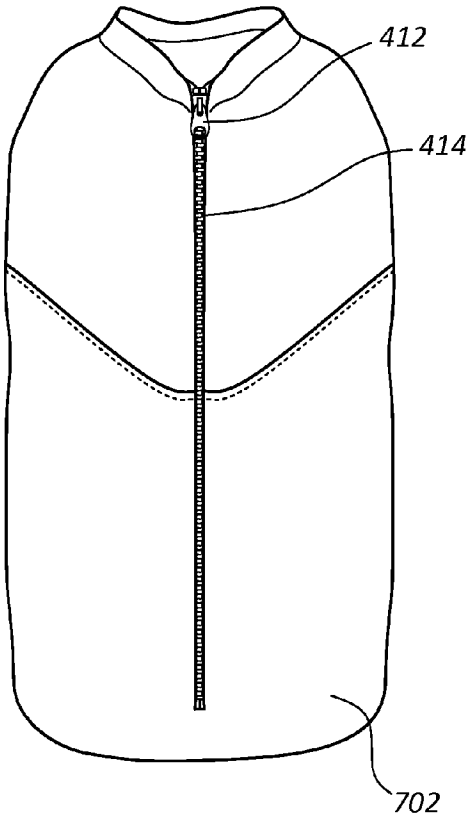
FIGS. 12*a-c* comprise front and back views of various embodiments of a swaddling enclosure utilizing different types of zippers.
Figure 12B:
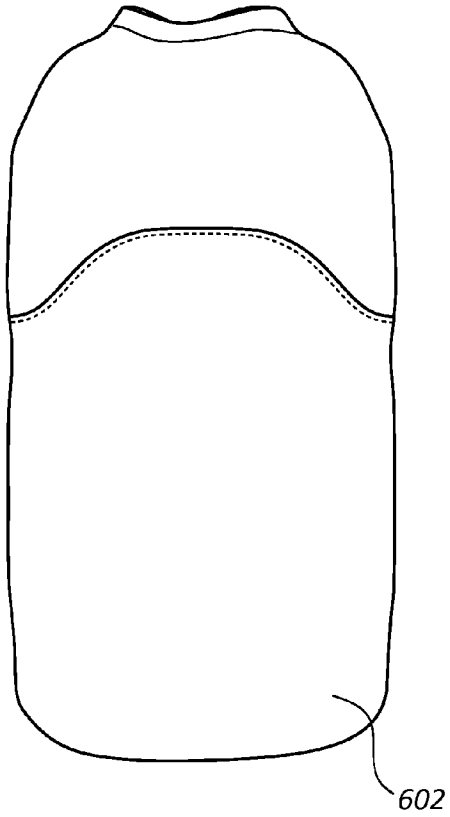
Figure 12A:
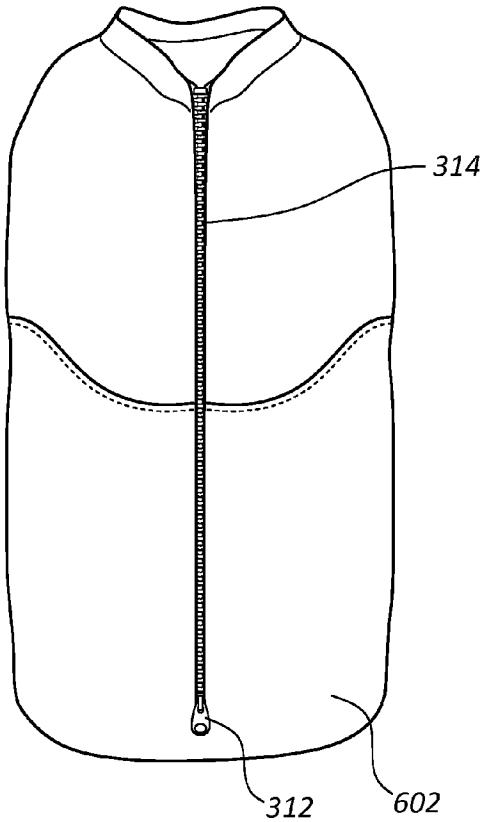

FIGS. 12*a-c* illustrate front and back views of various embodiments of the swaddling enclosure 602, 702. In particular, FIGS. 12*a-b* illustrate front and back views of an embodiment of the swaddling enclosure 602 including a zipper 314 with a single close-down grasp mechanism 312. FIG. 12*c* illustrates a front view of an embodiment of the swaddling enclosure 702 including a single close-up grasp mechanism 412 for the zipper 414.

Figure 13B:
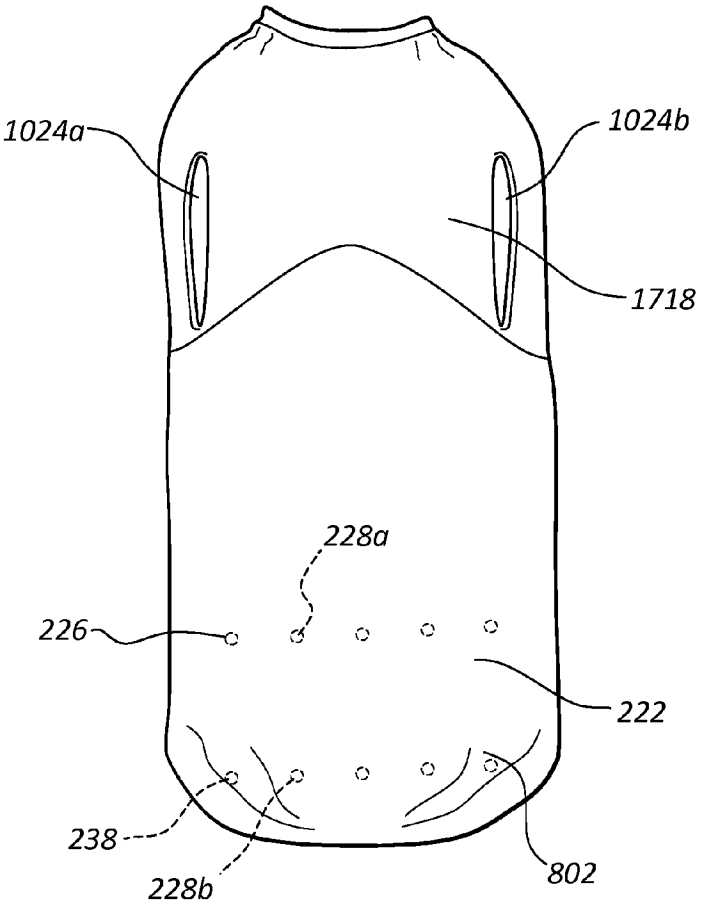
FIGS. 13*a-b* illustrate front and back views of an embodiment of the swaddling enclosure disposed in an inside-out condition.
Figure 13A:
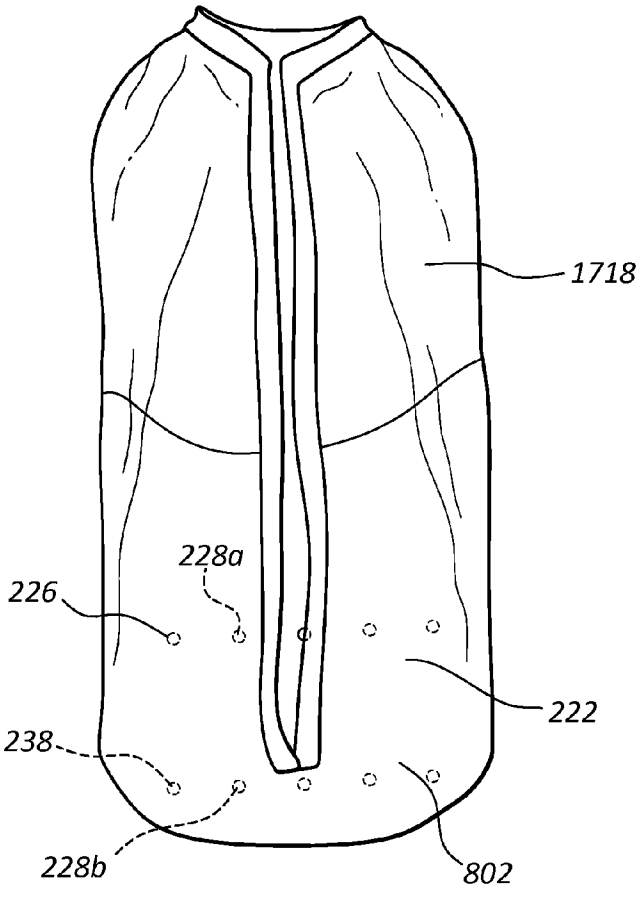

FIGS. 13*a-b* illustrate front and back view of one embodiment of the swaddling enclosure 802 in an inside-out orientation. Accordingly, these drawings illustrate the inner arm enclosure insert 1718 from both the front and back view when secured to the outer enclosure 222. The arm entry openings 1024*a-b* of the inner arm enclosure insert 1718 are shown in FIG. 13*b*. FIGS. 13*a-b* also illustrate a first row 226 of fastening mechanisms 228*a* and a second row 238 of fastening mechanisms 228*b* spaced apart from the first row 226. The illustrated fastening mechanisms 228*a-b*, may comprise, snap-type fastening mechanisms 228*a-b*. Each fastening mechanism 228*a* in the first row 226 corresponds to and is interlockable with an fastening mechanism 228*b* in the second row 238. The first row 226 and the second row 238 may be secured together to reduce the length of the space enclosed by the swaddling enclosure 802 and thereby enable enhanced swaddling of a smaller child. The first row 226 and the second row 238 comprise one embodiment of a length-reducing mechanism.

Figure 14C:
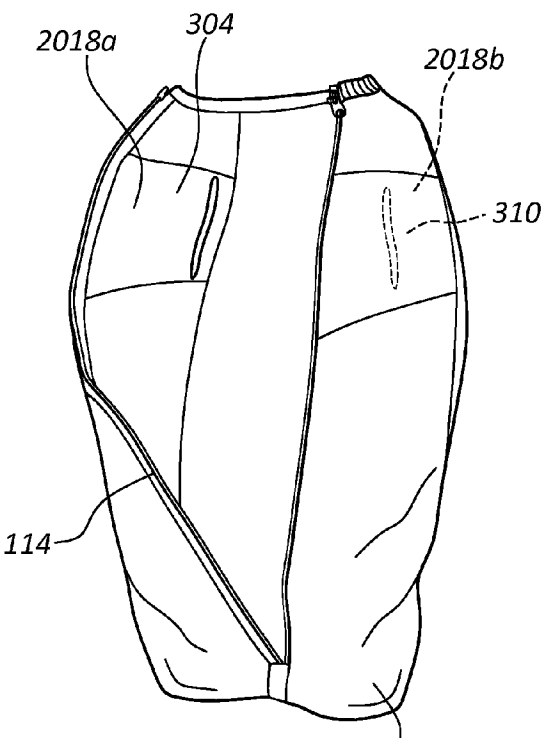
FIGS. 14*a-c* illustrate embodiments of the swaddling enclosure having various types of inner arm enclosure inserts.
Figure 14B:
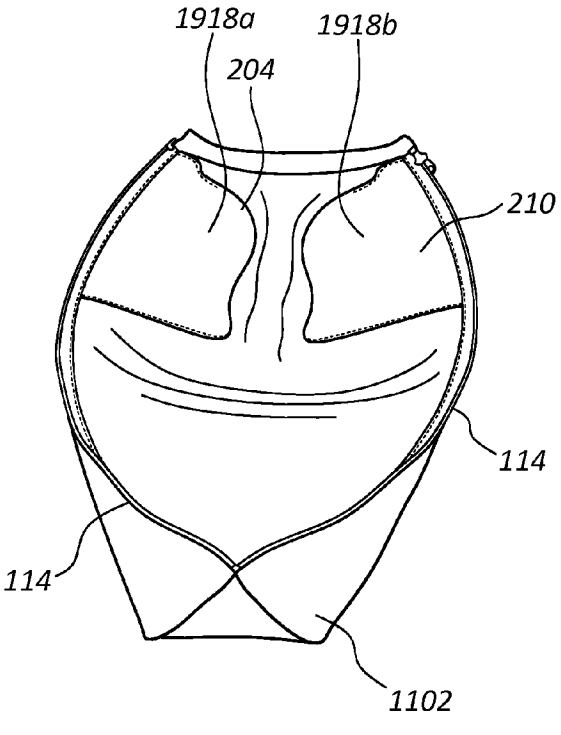
Figure 14A:
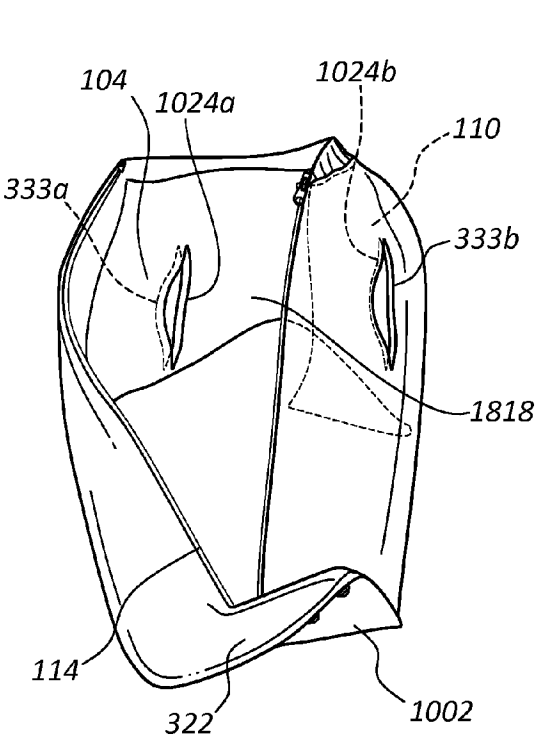

FIGS. 14*a-c* illustrate views of the swaddling enclosure 1002, 1102, 1202 with the zipper 114 opened such that one or more arm passageways 104, 110, 204, 210, 304, 310 are illustrated. FIG. 14*a* illustrates an embodiment in which the inner arm enclosure insert 1818 is comprised of a single piece of material, while FIGS. 14*b-c* illustrate embodiments in which the first and second inner arm enclosure inserts 1918*a-b*, 2018*a-b* are comprised of separate pieces of material.

In addition, FIG. 14*a* illustrates an embodiment in which the outer enclosure 322 includes a first outer enclosure arm exit opening 333*a* that corresponds to the first arm entry opening 1024*a* of the inner arm insert 1818 and a second outer enclosure arm exit opening 333*b* that corresponds to the second arm entry opening 1024*b* of the inner arm insert 1818. The first outer enclosure and second outer enclosure arm exit openings 333*a-b* enable a baby's arm to be positioned outside of the swaddling enclosure 1002 without removing the baby from the swaddling enclosure 1002. In addition, the first outer enclosure and second outer enclosure arm exit openings 333*a-b* provide access to the baby (for the purpose of, for example, giving the baby a shot or touching the baby) without removing the baby from the swaddling enclosure 1002.

Figure 15B:
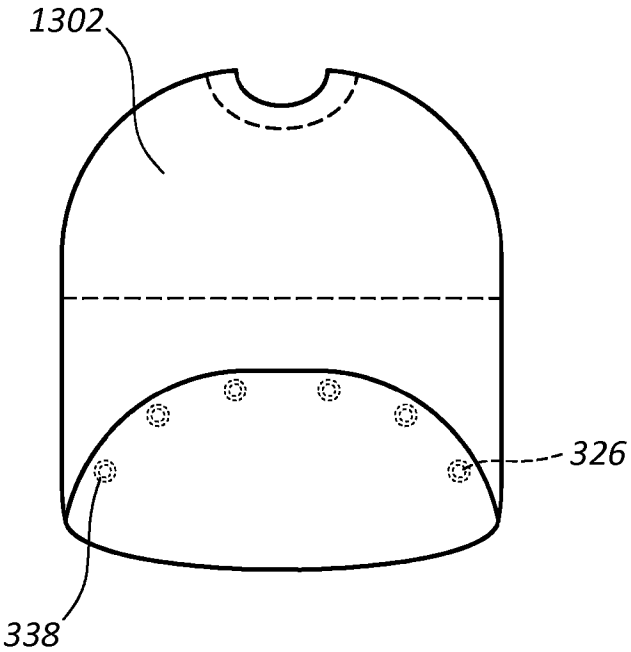
FIGS. 15*a-b* illustrate an embodiment of the swaddling enclosure including fastening mechanisms for reducing an effective length of the swaddling enclosure.
Figure 15A:
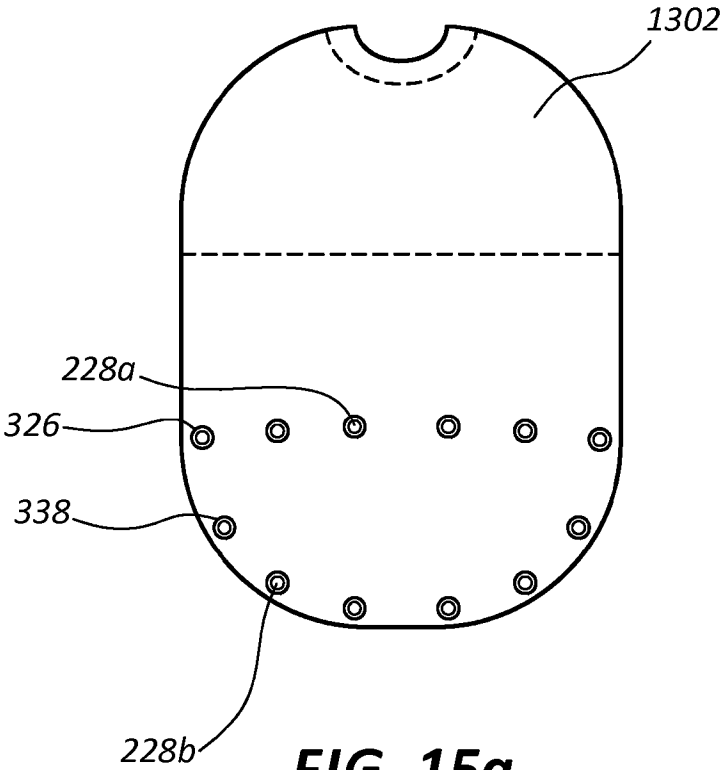

FIGS. 15*a-b* illustrate an embodiment comprising snaps 228*a-b* that enable the swaddling enclosure 1302 to be shortened, enabling a secure fit, even for a smaller baby, by fastening a first row 326 of fastening mechanisms 228*a* (e.g., snaps closer to the center of the swaddling enclosure) to a second row 338 of fastening mechanisms 228*b* (e.g., snaps farther from the center of the swaddling enclosure). The first and second rows 326, 338 are spaced apart from each other. As illustrated, snap-type fastening mechanisms 228*a-b* are utilized. However, alternative types of fastening mechanisms may be utilized, such as hooks or Velcro. FIG. 15*a* shows the swaddling enclosure 1302 in an elongated state (with the first row 326 of fastening mechanisms 228*a* and second row 338 of fastening mechanisms 228*b* not secured to each other), while FIG. 15*b* shows the swaddling enclosure 1302 in a shortened state (with the first row 326 and the second row 338 secured to each other). The rows 326, 338 comprise one embodiment of a length-reducing mechanism.

Figure 16C:
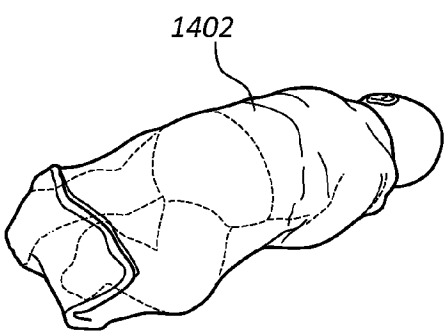
FIGS. 16*a-c* illustrate a method of using fastening mechanisms for reducing the effective length of the swaddling enclosure.
Figure 16B:
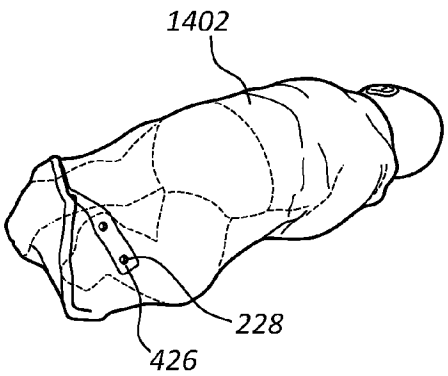
Figure 16A:
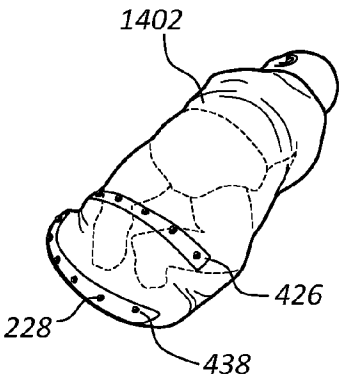

FIGS. 16*a-c* illustrate a method of utilizing a fastening mechanism 228 to reduce the length of the swaddling enclosure 1402. In particular, FIG. 16*a* shows two rows 426, 438 of fastening mechanisms 228 in the disengaged state; FIG. 16*b* shows the two rows 426, 438 of fastening mechanisms 228 in a partially engaged state; and FIG. 16*c* shows the two rows 426, 438 of fastening mechanisms 228 in a fully engaged state.

Figure 17B:
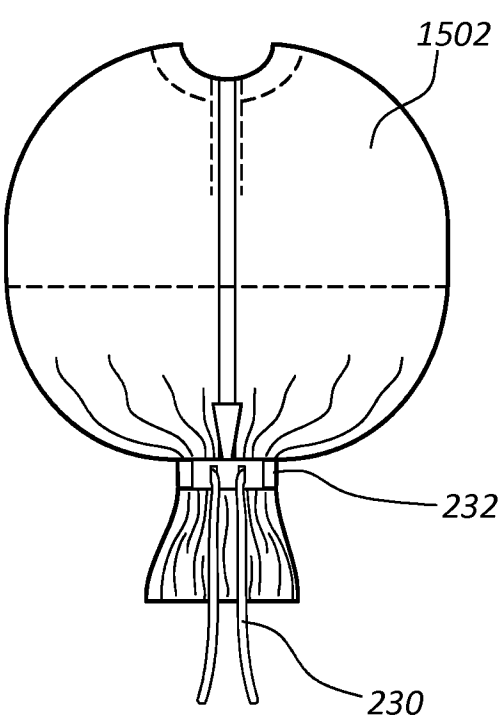
FIGS. 17*a-b* and 18*a-b* illustrate embodiments using drawstrings to reduce the effective length of the swaddling enclosure.
Figure 17A:
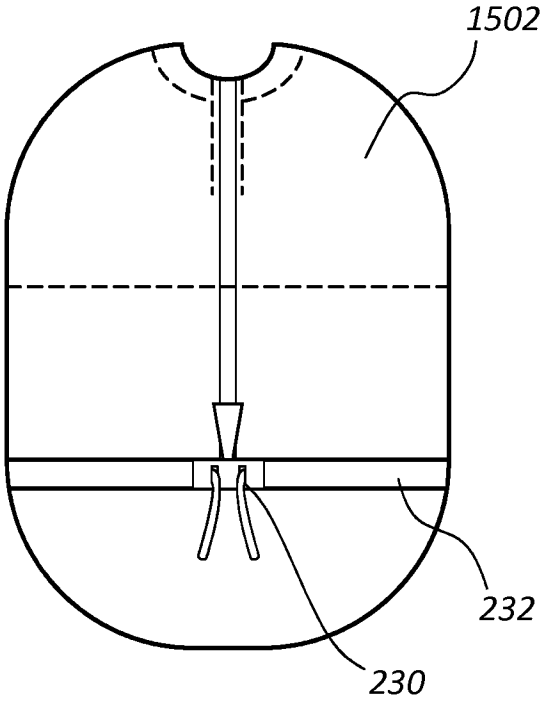

FIGS. 17*a-b* illustrate a circumferential drawstring 230. The drawstring 230 includes a circumferential passageway 232 with one or more openings. The drawstring 230 running through the passageway 232 can be pulled and tied (or fastened another way) in order to effectively reduce the length of the illustrated swaddling enclosure 1502. FIGS. 17*a-b* illustrate another length-reducing mechanism for the swaddling enclosure 1502.

Figure 18B:
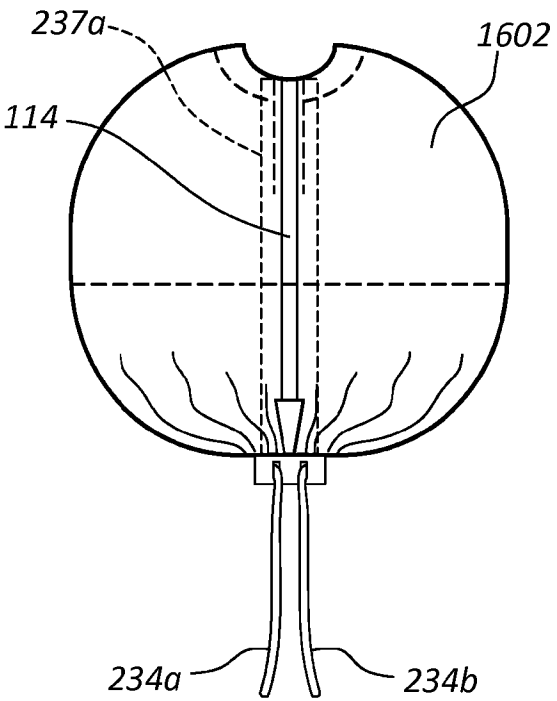
Figure 18A:
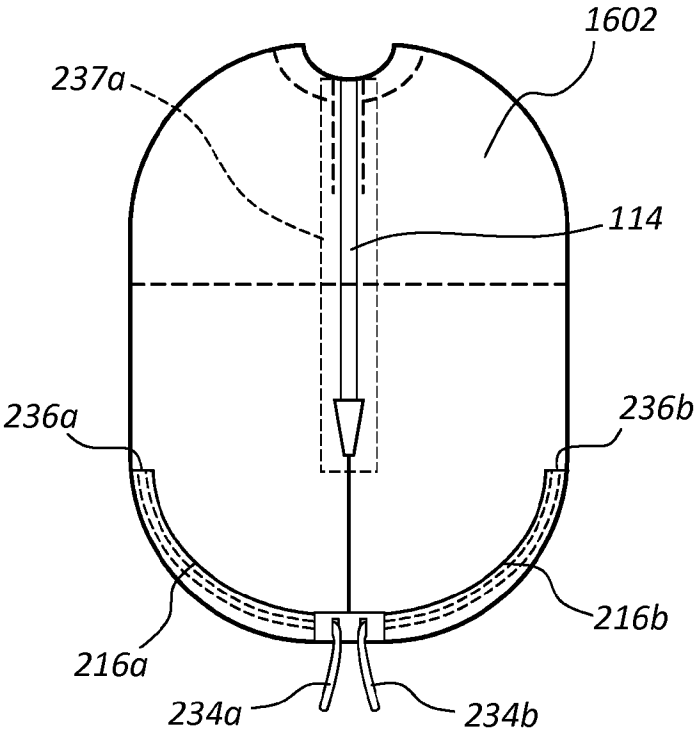

FIGS. 18*a-b* illustrate an alternative embodiment of the swaddling enclosure 1602 that utilizes a U-shaped drawstring 234*a-b*. In this embodiment, two drawstrings 234*a-b* are respectively fastened at proximal ends 236*a-b* of two separate passageways 216*a-b*. Once again, the effective length of the swaddling enclosure enclosure 1602 may be reduced by pulling the two strings 234*a-b* together and tying (or otherwise fastening) the strings 234*a-b*, as illustrated in FIG. 18*b*. Accordingly, FIGS. 18*a-b* illustrate yet another length-reducing mechanism for the swaddling enclosure 1602.

FIGS. 18*a-b* also illustrate an inner zipper cover 237*a*. The inner zipper cover 237*a* may comprise a piece of fabric that may be folded over the inner surface of the zipper 114 to prevent the zipper 114 from irritating the skin of a swaddled baby. The inner zipper cover 237*a* may be secured along an edge or at various portions to the swaddling enclosure 1602 to allow the cover 237*a* to be selectively positioned over the inner surface of the zipper 114.

Figure 19:
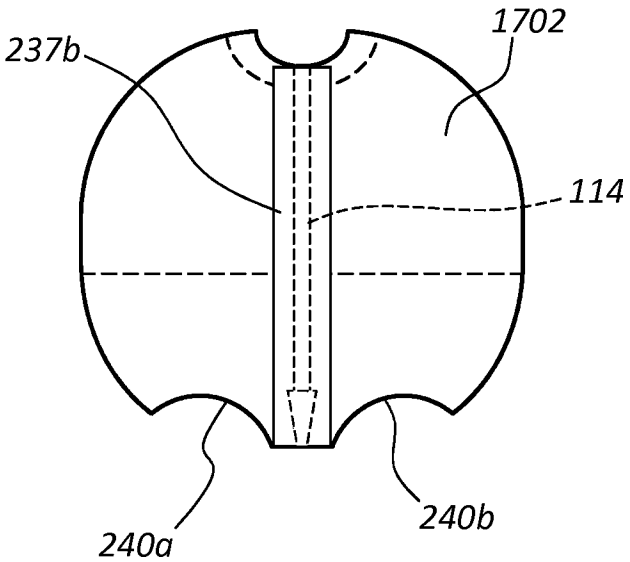
FIG. 19 illustrates an embodiment of the swaddling enclosure having openings through which an infant's legs may be inserted such that the legs are outside of the swaddling enclosure.

FIG. 19 illustrates an alternative embodiment of the swaddling enclosure 1702 comprising two leg exit openings 240*a-b* through which the legs of the infant may be inserted. This embodiment enables, for example, swaddling when an infant 100 (shown in FIG. 1) is positioned within an infant swing.

FIG. 19 also illustrates an outer zipper cover 237*b*. The outer zipper cover 237*b* may comprise a piece of fabric that may be folded over the outer surface of the zipper 114 to prevent the zipper 114 from irritating the skin of a person holding the swaddled baby. The outer zipper cover 237*b* may be secured along an edge or at various areas to the swaddling enclosure 1702 to allow the cover 237*b* to be selectively positioned over the outer surface of the zipper 114.

Figure 20C:
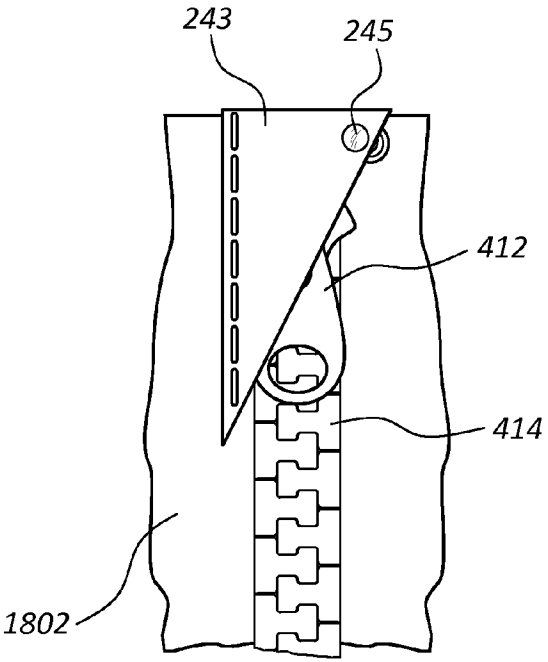
FIGS. 20*a-c* illustrates a triangular protective member used to mitigate potential irritation caused by a zipper grasp.
Figure 20B:
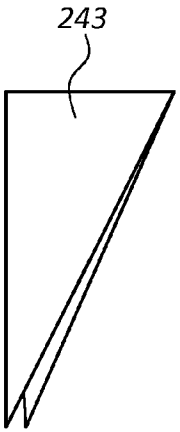
Figure 20A:
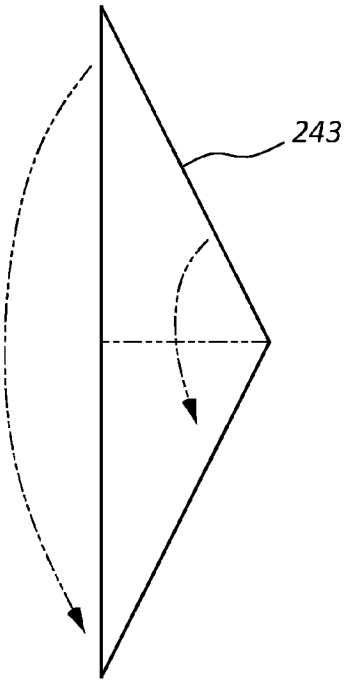

FIGS. 20*a-c* illustrate use of a triangular-shaped protective member 243 to form a protective shield for a grasp mechanism 412 of a zipper 414, which could otherwise irritate a baby's skin. As shown in these figures, the triangular-shaped protective member 243 may be folded, as illustrated in FIG. 20*b*, and then secured to a swaddling enclosure 1802 so as to form a protective shield about a grasp mechanism 412. The triangular-shaped protective member 243 may include a fastening member 245 (e.g., a snap, a hook, or Velcro) for securing the triangular-shaped member over the grasp mechanism 412. Of course, alternative shapes may be used as a protective member 243, such as a rectangular-shaped member.

Figure 21C:
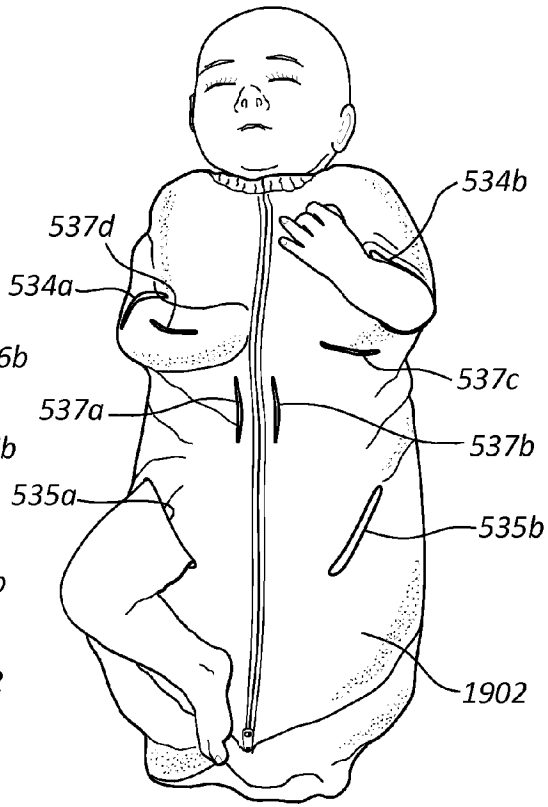
FIGS. 21*a-c* illustrate a swaddling enclose including outer enclosure leg and arm exit openings and other outer enclosure access openings.
Figure 21B:
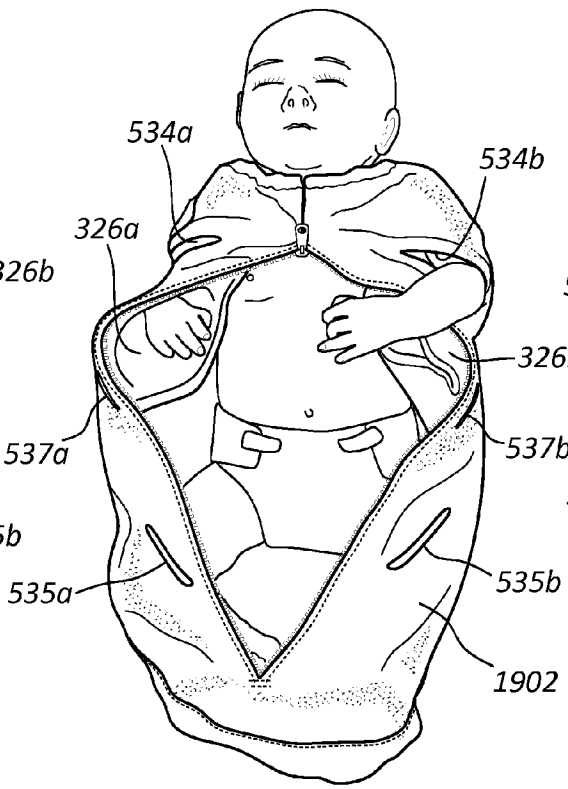
Figure 21A:
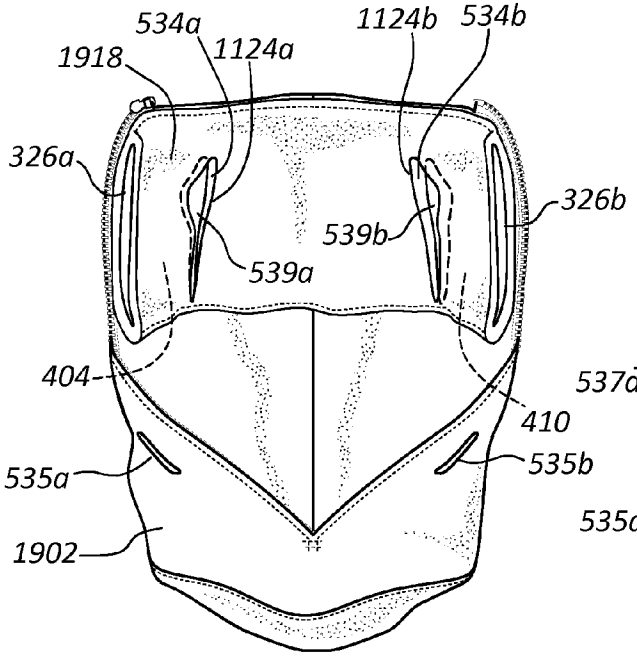

FIGS. 21*a-c* illustrate an embodiment of the swaddling enclosure 1902 that includes one or more outer arm enclosure exit openings 534*a-b* corresponding to arm entry openings 1124*a-b*. The outer arm enclosure exit openings 534*a-b* allow one or more arms of the baby to be positioned through corresponding arm entry openings 1124*a-b* and outer arm enclosure exit openings 534*a-b* to position the baby's arms outside of the swaddling enclosure 1902 while the baby is positioned within the swaddling enclosure 1902, as illustrated in FIGS. 21*b-c*. The outer arm enclosure exit openings 534*a-b* also allow access to a baby's arm, such as for utilizing an intravenous tube or giving the baby a shot when the baby is positioned within the swaddling enclosure 1902.

The illustrated swaddling enclosure 1902 may also include one or more outer enclosure leg exit openings 535*a-b*. The outer enclosure leg exit openings 535*a-b* allow a swaddled baby's legs to be positioned outside of the enclosure (as illustrated in FIG. 21*c*) and also allow access to the babies legs during swaddling, as desired.

The swaddling enclosure may also include other outer enclosure access openings 537*a-d* that provide other access points to a swaddled baby.

The swaddling enclosure of FIGS. 21*a-c* also illustrate another embodiment of an inner arm enclosure insert 1918. The illustrated inner arm enclosure insert 1918 is folded over, as illustrated in FIG. 21*a*, such that arm passageways 404, 410 and arm exit openings 326*a-b* may be formed between the folded layers of the inner arm enclosure insert 1918. Accordingly, in the illustrated embodiment, the outer arm enclosure exit openings 534*a-b* may further utilize a corresponding outer layer opening 539*a-b* in the outer layer of the illustrated inner arm enclosure insert 1918 to allow passage of a swaddled baby's arm through the outer arm enclosure exit openings 534*a-b*.

Figure 22B:
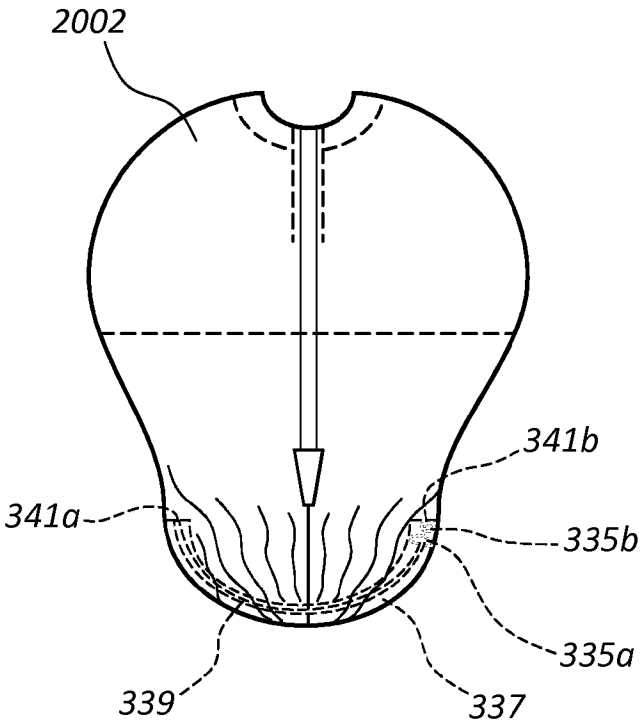
FIGS. 22*a-b* illustrate another embodiment of a length-reducing mechanism.
Figure 22A:
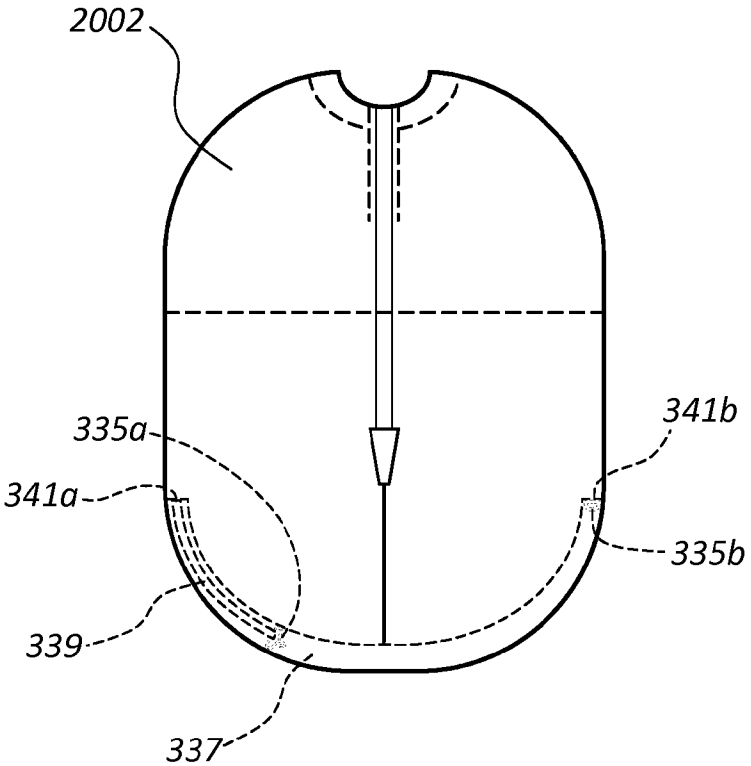

FIGS. 22*a-b* illustrates yet another embodiment of a length-reducing mechanism. The length-reducing mechanism includes an arcuate arcuate passageway 337 having a first end 341*a* and a second end 341*b*. A cord 339 is secured at one end to the first end 341*a* of the passageway 337 and, at the other end, to a first engaging mer member 335*a*. A second engaging mer member 335*b* is secured to the second end 341*b* of the arcuate passageway 337. The engaging members 335*a-b* may comprise, for example, a hook and loop or mating snaps. The first engaging member 335*a* may be drawn through the arcuate passageway 337 and secured to the second engaging member 335*b* to reduce the length of the swaddling enclosure 2002, as illustrated in FIG. 22*b*.

Figure 23B:
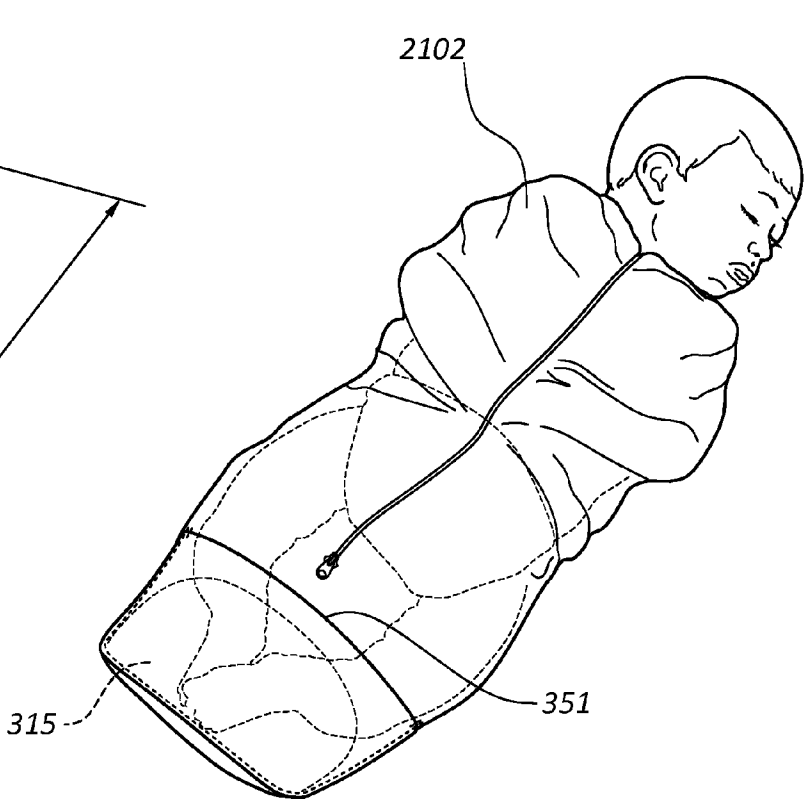
FIGS. 23*a-b* illustrate yet another embodiment of a length-reducing mechanism for a swaddling enclosure.
Figure 23A:
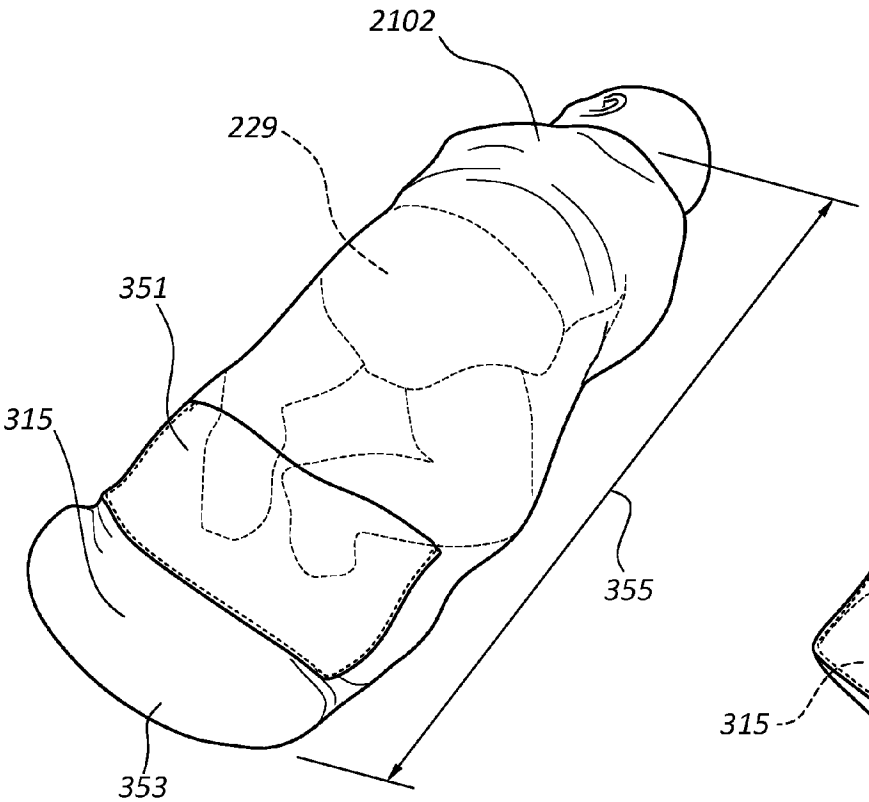

FIGS. 23*a-b* illustrate another embodiment of a length-reducing mechanism. In this embodiment, the swaddling enclosure 2102 includes a length-reducing pocket 351 that is spaced apart, or offset, from a distal end 353 of the swaddling enclosure 2102, which comprises the foot area 315 of the swaddling enclosure 2102. The length-reducing pocket 351 may be turned inside-out and positioned around a distal end 353 of the swaddling enclosure 2102, as illustrated in FIG. 23*b*. Accordingly, the distal end 353 may be folded within the length-reducing pocket 351, thereby reducing a length 355 of the consolidated enclosed space 229 defined by the swaddling enclosure 2102 (as is the case with each of the length-reducing embodiments or mechanisms described herein).

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention. For example, disclosed features may be combined or utilized in connection with other embodiments, as will be recognized by those of skill in the art. Further, for example, although sewing and stitching are disclosed herein, other types of securing techniques may be utilized, such as ultrasonic welding or weaving fabric into a desired form.

What is claimed is:

1. A swaddling enclosure, comprising:

an outer enclosure comprising a first enclosure region defining a first enclosed space and a second enclosure region defining a second enclosed space, the first enclosure region comprising a first opening edge and a first neck edge, the second enclosure region comprising a second opening edge and a second neck edge, an opening bounded by the first opening edge and the second opening edge, the first and second opening edges meeting at a common point and being selectively securable to each other, a neck opening defined by the first neck edge and the second neck edge, the first neck edge being contiguous with the first opening edge and the second neck edge, the second neck edge being contiguous with the first neck edge and the second opening edge, the first enclosure region comprising a first shoulder region defining a first shoulder recess, the second enclosure region comprising a second shoulder region defining a second shoulder recess, the first enclosure region having an inner surface adjacent to the first enclosed space, the second enclosure region having an inner surface adjacent to the second enclosed space;

an inner arm enclosure insert comprising:

a first inner arm enclosure region secured to the inner surface of the first enclosure region and, together with the first enclosure region, defines a first arm passageway having a first arm entry opening, the first arm entry opening being disposed proximate the first shoulder region, the first arm passageway extending from the first shoulder region towards the first opening edge, the first inner arm enclosure region being secured to the first enclosure region along a collar sew line; and a second inner arm enclosure region secured to the inner surface of the second enclosure region and, together with the second enclosure region, defines a second arm passageway having a second arm entry opening, the second arm entry opening being disposed proximate the second shoulder region, the second arm passageway extending from the second shoulder region towards the second opening edge, the second inner arm enclosure region being secured to the second enclosure region along the collar sew line, the collar sew line extending adjacent to at least one of the first neck edge and the second neck edge and extending on a back portion of the outer enclosure.

2. The swaddling enclosure of claim 1, wherein the first arm passageway has no opening besides the first opening, and the second arm passageway has no opening besides the second opening.

3. The swaddling enclosure of claim 1, wherein the first arm entry opening is disposed within the first enclosed space and the second arm entry opening is disposed within the second enclosed space.

4. The swaddling enclosure of claim 3, wherein the first inner arm enclosure region and outer enclosure define a first arm exit opening, and the second inner arm enclosure region and outer enclosure define a second arm exit opening, first arm exit opening being disposed within the first enclosed space, and the second arm exit opening being disposed within the second enclosed space.

5. The swaddling enclosure of claim 4, wherein the first arm entry opening and the first arm exit opening are disposed at generally opposite ends of the first arm passageway.

6. The swaddling enclosure of claim 1, wherein the first arm passageway spans from the first shoulder region to the first opening edge, and wherein the second arm passageway spans from the second shoulder region to the second opening edge.

7. The swaddling enclosure of claim 1, wherein the first and second opening edges are selectively securable to each other using a zipper.

8. The swaddling enclosure of claim 1, wherein the first and second inner arm enclosure regions comprise a unitary piece of fabric.

9. The swaddling enclosure of claim 1, wherein the first and second enclosure regions comprises a unitary piece of fabric.

10. The swaddling enclosure of claim 1, wherein the first enclosure region comprises a first foot region defining a first foot recess, the first foot region being disposed generally opposite the first shoulder region on the first enclosure region, and wherein the second enclosure region comprises a second foot region defining a second foot recess, the second foot region being disposed generally opposite the second shoulder region on the second enclosure region.

11. The swaddling enclosure of claim 1, further comprising a length-reducing mechanism for reducing a length of space defined by the swaddling enclosure.

12. The swaddling enclosure of claim 11, wherein the length-reducing mechanism comprises snaps.

13. The swaddling enclosure of claim 12, wherein the snaps comprise a first row of snaps spaced apart from a second row of snaps, wherein each snap in the first row corresponds to and is interlockable with a snap in the second row.

14. The swaddling enclosure of claim 11, wherein the length-reducing mechanism comprises a drawstring.

15. A method of utilizing the swaddling enclosure of claim 1, comprising:

inserting a first arm of a baby through the first arm entry opening such that the first arm of the baby is positioned within the first arm passageway;

inserting a second arm of the baby through the second arm entry opening such that the second arm of the baby is positioned within the second arm passageway; and securing, at least partially, the first and second opening edges of the swaddling enclosure to each other such that a body of the baby is positioned within the first and second enclosed spaces.

16. The method of claim 15, further comprising positioning feet of the baby within a foot region of the swaddling enclosure.

17. A method of manufacturing the swaddling enclosure of claim 1, comprising:

securing the first inner arm enclosure region to the inner surface of the first enclosure region; and securing the second inner arm enclosure region to the inner surface of the second enclosure region.

18. The method of manufacturing the swaddling enclosure of claim 17, wherein securing the first inner arm enclosure region to the inner surface of the outer enclosure comprises:

sewing the first inner arm enclosure region to the first enclosure region along a perimeter sew line of the first inner arm enclosure, the perimeter sew line of the first inner arm enclosure traversing at least a portion of a perimeter of the first inner arm enclosure region.

19. The method of manufacturing the swaddling enclosure of claim 18, further comprising:

folding first and second front regions of the outer enclosure along outer enclosure fold lines such that the first and second front regions are generally disposed adjacent to a back region of the outer enclosure; and sewing a first foot region sew line on the first front region and a second foot region sew line on the second front region to a back foot region sew line on the back region of the outer enclosure.

20. The method of manufacturing the swaddling enclosure of claim 19, further comprising:

sewing a first shoulder region sew line on the first front region of the outer enclosure to a second shoulder region sew line on the back region of the outer enclosure.

* * * * *